United States Patent [19]

Zemke, deceased et al.

[11] Patent Number: 4,544,146

[45] Date of Patent: Oct. 1, 1985

[54] INSERTION MACHINE WITH CONTROL SIGNALS STORED ON SEARCHABLE MEDIUM

[75] Inventors: Edward H. Zemke, deceased, late of Chicago, Ill., by Anne Zemke, legal representative; Harold D. Pogue, Chicago; Girish B. Shah, Schaumburg; Myron A. Bowles, Waukegan, all of Ill.

[73] Assignee: Bell & Howell Company, Chicago, Ill.

[21] Appl. No.: 525,767

[22] Filed: Aug. 23, 1983

[51] Int. Cl.[4] ..... B65H 39/02

[52] U.S. Cl. ..... 270/58; 340/825.52; 340/825.83

[58] Field of Search ..... 270/54–56, 270/57–58; 340/674–676, 686, 802, 825.52, 825.83

[56] References Cited

U.S. PATENT DOCUMENTS

| | | | |
|---|---|---|---|
| 3,570,840 | 11/1971 | Sather et al. | 270/58 |
| 3,606,728 | 9/1971 | Sather | 270/58 |
| 3,819,173 | 6/1974 | Anderson et al. | 270/58 |
| 3,899,165 | 8/1975 | Abram et al. | 270/58 X |
| 3,902,708 | 9/1975 | Wise et al. | 270/58 |
| 3,917,252 | 11/1975 | Harder et al. | 270/58 |
| 3,924,846 | 12/1975 | Reed | 270/58 |
| 3,972,521 | 8/1976 | Reed | 270/58 |
| 4,121,818 | 10/1978 | Riley et al. | 270/58 |
| 4,168,828 | 9/1979 | McLear | 270/58 |
| 4,211,483 | 7/1980 | Hannigan | 270/58 |

*Primary Examiner*—E. H. Eickholt

*Attorney, Agent, or Firm*—Griffin, Branigan, & Butler

[57] ABSTRACT

An insertion machine system includes an insertion machine 100 of a type wherein a plurality of insert stations 152 are positioned proximate conveyor means 120 travelling therealong for selectively feeding inserts onto the conveyor means 120. A buffer and turnover assembly 106 receives a printed envelope from in-line printer means 104 and automatically introduces the printed article onto the conveyor 120 travelling proximate the insertion stations 152. A data processor 108 governs the acquisition from an information storage medium of information indicative of text to be printed on an envelope and information indicative of insert machine control signals. The data processor 108 further governs the operation of the printing means 104 whereby the printing means 104 prints on an envelope readable text. The data processing means 108 also communicates the insertion machine control signals to the insert machine 100, as well as govern the introduction by the buffer turnover assembly 106 of the printed envelope onto the conveyor means 120.

3 Claims, 23 Drawing Figures

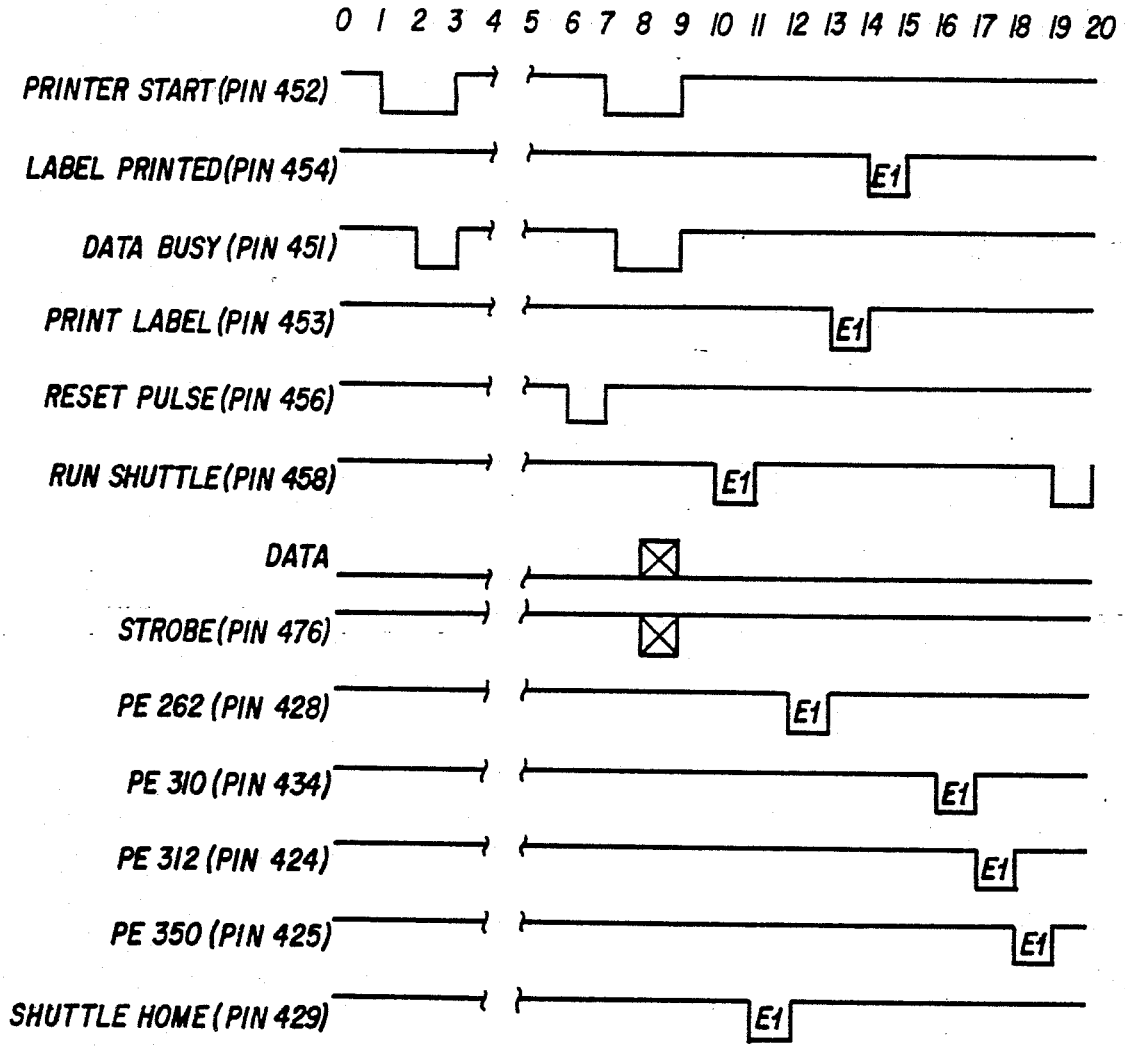
FIG. 6
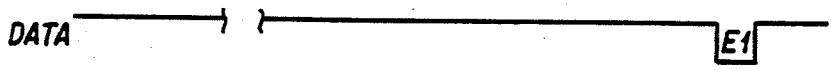
FIG. 7
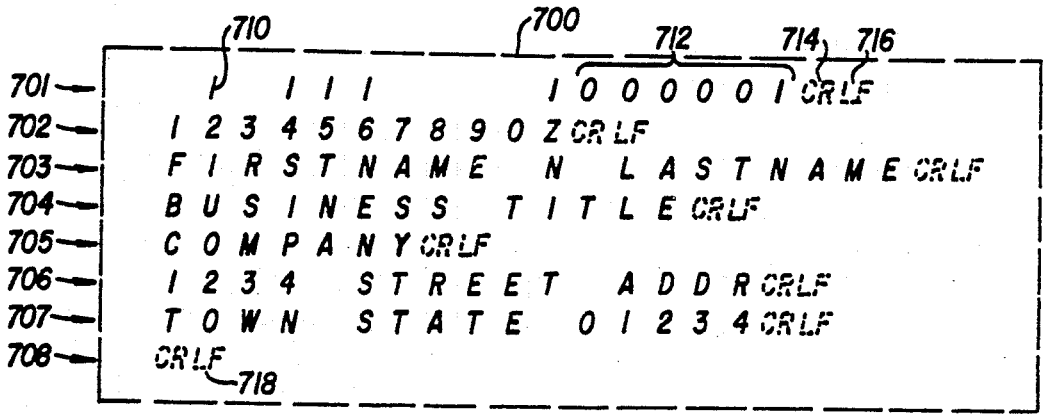

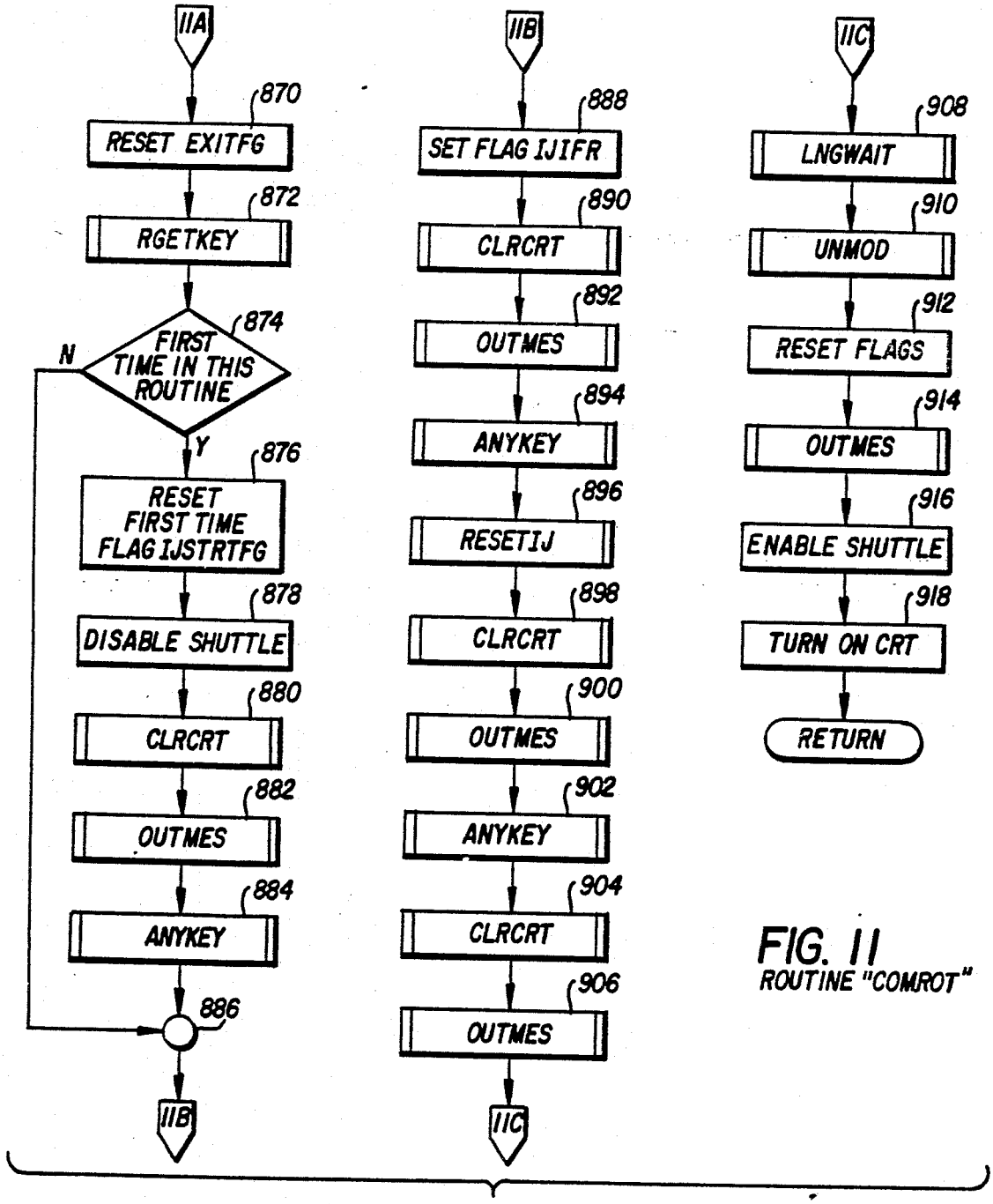
FIG. 11
ROUTINE "COMROT"
FIG. 8
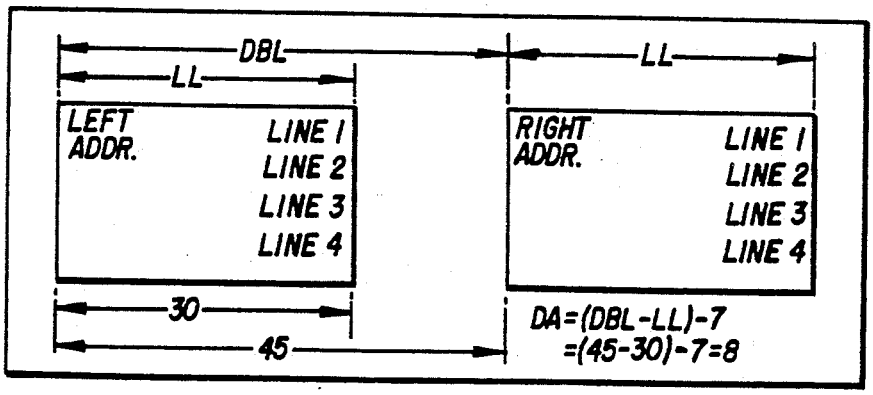

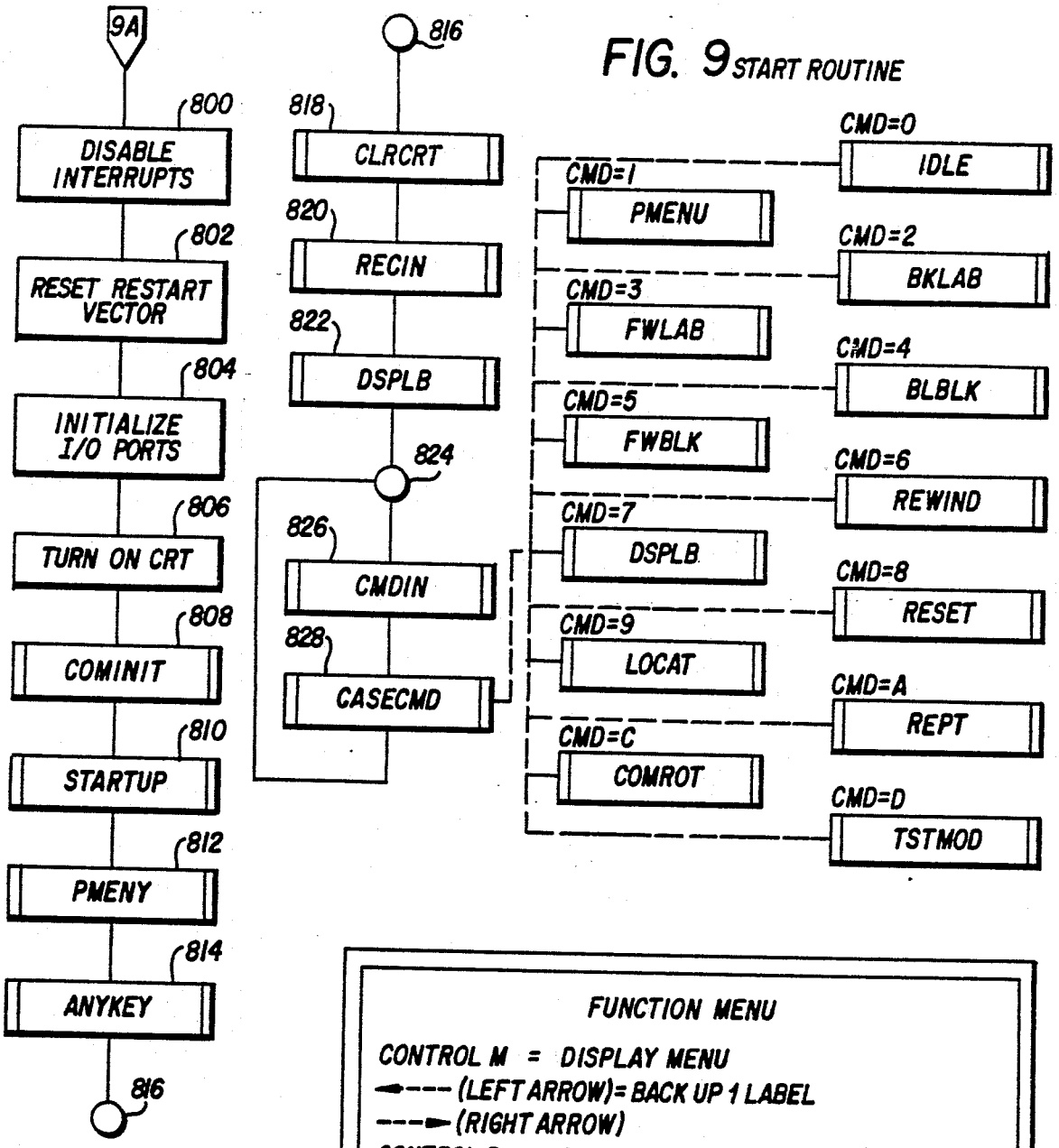

FIG. 9 START ROUTINE

FUNCTION MENU

CONTROL M = DISPLAY MENU
◄---- (LEFT ARROW)= BACK UP 1 LABEL
----► (RIGHT ARROW)
CONTROL B = BACK UP 1 BLOCK
CONTROL F = FORWARD 1 BLOCK
CONTROL T = REWIND TO START OF TAPE
CONTROL D = DISPLAY DATA
CONTROL X = RESET
CONTROL L = CALL LOCATE STRING FUNCTION
CONTROL R = REPEAT LOCATE FOR NEXT STRING
CONTROL J = CONT. FROM LAST LABEL BEFORE LOCATE
CONTROL P = CALL PRINT OUT FUNCTION
CONTROL Z = TOGGLE TEST MODE

PRESS ANY KEY TO CONTINUE

FIG. 10

ROUTINES "TRACK" AND "PRINT"

ROUTINE RPRTLB

ROUTINE RPRTLB

ROUTINE "LOCAT"

INSERTION MACHINE WITH CONTROL SIGNALS STORED ON SEARCHABLE MEDIUM

BACKGROUND

A microfiche appendix comprised of a single microfiche having 92 frames was included with the application for this patent.

This invention pretains to insertion machines, and particularly to insertion machines of a type wherein a plurality of insert stations are positioned proximate a conveyor means travelling therealong for selectively feeding inserts onto the conveyor means.

Inserter machines such as that disclosed in U.S. Pat. No. 2,325,455 to A. H. Williams are the well known Phillipsburg inserters. These inserters effect the removal and/or collation of document-type pieces of mail and like material from one or more stacks, insertion of the same into envelopes, and sealing, stamping and stacking the envelopes ready for mailing. This is accomplished in a high speed, continuous, automatic fashion by withdrawing stacked inserts from one or more insert stations located alongside an insert transportation mechanism, generally referred to as an insert track, comprising a conveyor which is intermittently advanced in timed relation to oscillating gripper arm means, having jaw structure, which successively remove the inserts from the stack in the magazine structure at each insert station and deposit the withdrawn inserts onto the conveyor of the insert track. The inserts eventually arrive at an inserting station where they are stuffed into the envelopes.

Heretofore the envelopes into which inserts were stuffed by insertion machines had addresses printed thereon at a location remote from the insertion machine main frame structure. Various types of printers, including ink jet printers, have been used to address envelopes supplied to the printer from an envelope hopper. The printed envelopes were discharged into an output bin from which they could be manually collected for eventual manual loading into an appropriate envelope hopper or the like on the main frame of the insertion machine.

It has been known in the prior art to obtain from magnetic tape the information necessary for printing addresses on envelopes. In this manner a plurality of envelopes are addressed by suitable printing means in accordance with information acquired from a corresponding plurality of address records physically coded on the magnetic tape. Each address record includes in specified format a sequence number indicative of the particular customer whose address information is stored in the address record. In certain embodiments such printers which interface with tape drives have logic circuits and a keyboard operative therewith. If, in such embodiments, it is desired to print an envelope for a particular customer, the customer's sequence number can be entered via the keyboard to enable the printer logic to physically locate on the tape the appropriate address record and to print an envelope for the customer.

On very rare occasions insertion machines have been known to jam, particularly at a station wherein inserts are stuffed into an envelope. The jam may cause an envelope to be mutilated, in which case it is necessary to prepare another addressed envelope. In certain instances new envelopes can be prepared using the prior art keyboard-type printer embodiments described above. Yet while prior art printer systems which use tape input were able to search downstream for a customer's address record in response to a keyed-in sequence number, such systems were unable to search back upstream unless the entire tape were rewound. Rewinding the tape and searching ab initio for the customer's sequence number consumed time, particularly when a sizeable address list was being processed. Moreover, even in cases in which a new envelope were printed in place of a damaged envelope and manually introduced into the insertion machine, the new envelope as it travelled down the insert track would be out of order rather than being in the position of the old envelope. In most insertion machine applications the ordering of envelopes is important, particularly when envelopes are being grouped according to zip code in order to take advantage of lower postal rates.

Insertion machine systems of the prior art, even those in which customer address records are stored on magnetic tape or the like, do not possess an effective capability of searching through a customer list in search of all customer records having particular information other than customer sequence number included therein, such as, for example, all customers having a certain zip code, or a certain city, state, or street address, or even a particular corporate affiliation.

Therefore, an object of this invention is the provision of an insertion machine wherein printed envelopes are automatically transported from a printer to an envelope track of an insertion machine.

An advantage of the present invention is the provision of an insertion machine system and method wherein information indicative of insertion machine control signals or instructions are coded on storage medium for use in operating the insertion machine.

A further advantage of the present invention is the provision of an insertion machine system and method wherein information indicative of insertion machine control signals or instructions are printed on envelopes.

Yet another advantage of the present invention is the provision of an insertion machine system wherein machine jams can be easily rectified by the rapid printing of new envelopes.

Still another advantage of the present invention is the provision of means for indicating the zip code relationship of reprinted envelopes to other envelopes travelling on conveyor means of an insertion machine system.

Another advantage of the invention is the provision of an insertion machine system capable of searching through customer address records to locate customer records having information stored therein which matches information sought by an operator.

SUMMARY

An insertion machine system includes an insertion machine of a type wherein a plurality of insert stations are positioned proximate conveyor means travelling therealong for selectively feeding inserts onto the conveyor means. A buffer and turnover assembly receives a printed envelope from in-line printer means and automatically introduces the printed article onto the conveyor travelling proximate the insertion stations. A data processor governs the acquisition of an information storage medium from information indicative of text to be printed on an envelope and information indicative of insert machine control signals. The data processor further governs the operation of the printing means whereby the printing means prints on an envelope readable text. The data processing means also communicates the insertion machine controls signals to the insert machine, as well as govern the introduction by the buffer turnover assembly of the printed envelope onto the conveyor means.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 6 is a schematic diagram showing timing relationships in the operation of an inserter machine according to an embodiment of the invention;

FIG. 7 is a diagram showing the format of an address block printed on an envelope in accordance with an embodiment of the invention;

FIG. 8 is a diagram showing a formula utilized in connection with a dual address offset feature provided with an insertion machine in accordance with an embodiment of the invention;

FIG. 9 is a diagram showing processing steps included in a routine START executed by data processing means according to an embodiment of the invention;

FIG. 10 is a diagram showing a FUNCTION MENU display on a monitor, the display being generated by a routine PMENU executed by data processing means of an embodiment of the invention;

FIG. 11 is a diagram showing processing steps included in a routine COMROT executed by data processing means according to an embodiment of the invention;

DETAILED DESCRIPTION OF THE DRAWINGS

Figure 1:
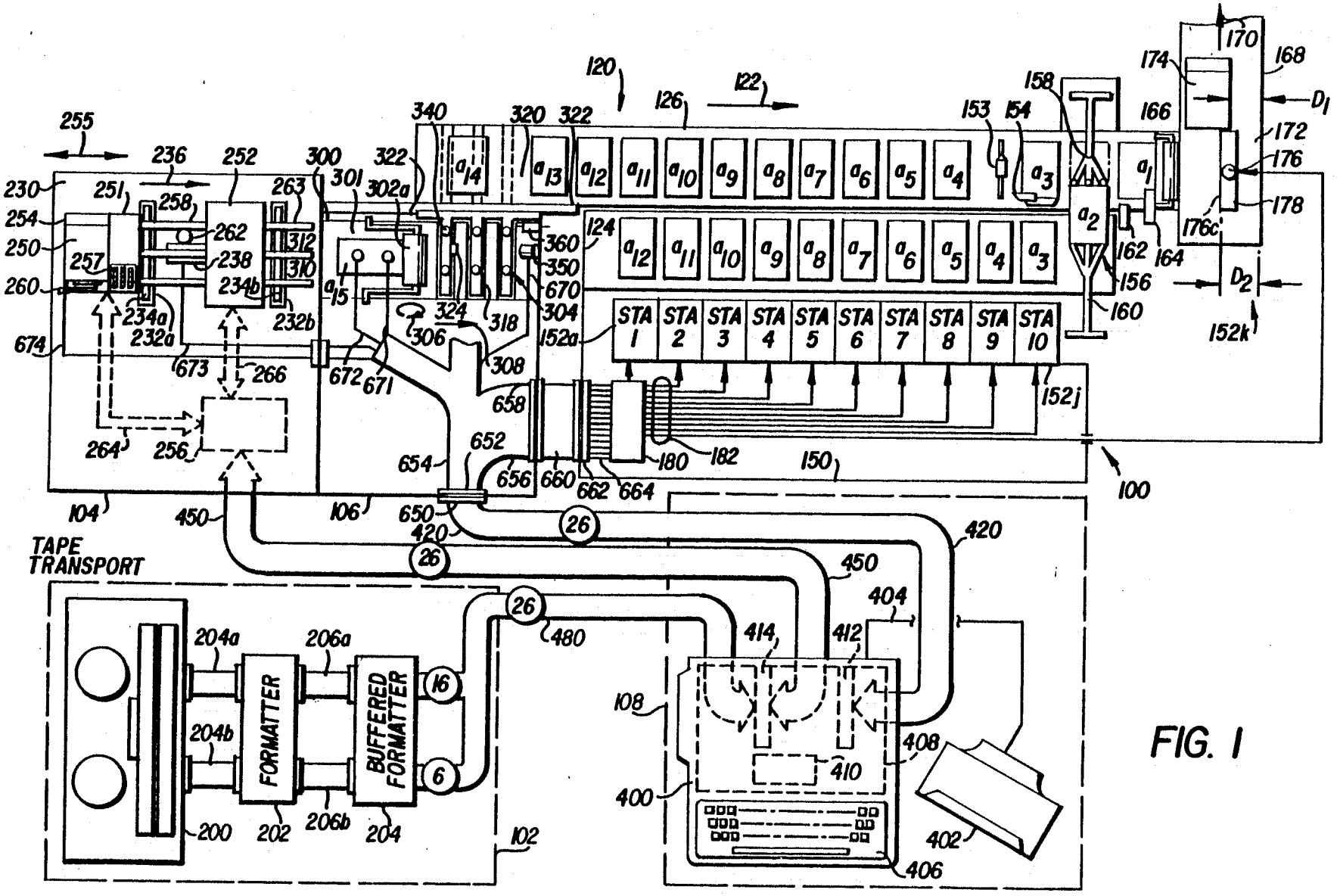
FIG. 1 is a schematic view of an inserter system of an embodiment of the invention including information storage means, data processing means, and printer means.

FIG. 1 illustrates an inserter machine system including an inserter machine 100; information storage means 102; printing means 104; a buffer and turnover assembly (BAT) 106; and, data processing means 108.

The inserter machine 100 includes conveying means 120 for moving articles, documents or the like in the direction of arrow 122. The conveying means 120 shown in FIG. 1 comprises two tracks: an insert track 124 and an envelope track 126. Both tracks 124 and 126 are linked to the inserter machine main drive shaft which indexes the tracks in the direction of arrow 122.

A main frame portion 150 includes a plurality of insert stations 152*a*–152*j* adapted to feed inserts, such as documents or the like, onto the insert track 124. The embodiment of the inserter machine 100 shown in FIG. 1 is a Bell & Howell Model CMK-10 inserter machine which includes ten insert stations 152*a*–152*j* and a zip kicker station 152*k*. Although unillustrated in detail, each insert station 152 includes a hopper, feeding means (such as a fast feeder or a gripper arm-type feeder), and means for enabling the feeding means to pull an insert from the hopper.

In the above regard, the de tailed structure of the inserter machine 100 including the insert stations 152, is known from U.S. Pat. No. 2,325,455 to Williams which is incorporated herein by reference. Further, it is well known from the referenced Williams patent that the inserter machine 100 includes a main drive motor and associated belt drives, stub shafts, reduction gearing, and a main drive shaft. Although not specifically illustrated herein but understood with reference to the Williams patent, the main drive shaft performs numerous functions, including providing the intermittent indexing drive for the conveying means 120 and providing the drive for operating the feeding means for each insert station 152.

On the envelope track 126 at a position even with insert station 152*i* is an envelope advancement means for advancing the position of envelopes travelling thereunder so that an addressee's envelope moves to a position in which it is even with respect to the addressee's inserts. In the embodiment shown the envelope advance means is a rotating roller 153. Prior to being advanced by the roller 153, each addressee's envelope on track 126 trails its corresponding inserts on track 124 by one position.

An envelope flap opening means 154 is situated slightly above the envelope track 126 even with insert station 152*j* to open the flaps of envelopes passing thereunder. Downstream from insert station 152*j* is a stuffing station 156 wherein vacuum-operated envelope opening means 158 lifts up the back flap of each envelope so that a reciprocating pusher arm 160 can load inserts into an open envelope.

Downstream from the stuffing station 156 is an envelope flap moistening station 162 and an envelope flap closing station 164. A rotating discharge roller 166 selectively pivots toward and away from the track 126 to discharge stuffed and sealed envelopes onto an orthogonally-oriented conveyor 168 travelling in the direction of arrow 170.

Unless specified otherwise hereinafter, envelopes discharged by roller 166 are propelled onto the conveyor 168 so that the leading edge of the envelope upon discharge will be at a distance $D_1$ from the far edge 172 of conveyor 168. Envelope 174 shown in FIG. 1 is an example of such an envelope. However, when a zip kicker option is indicated for a particular addressee in the manner hereinafter described, a solenoid 176 mounted in perpendicular fashion above the conveyor 168 drives a bar-like member or "zip kicker" 178, usually in an elevated position above the conveyor 168, downwardly toward the conveyor 168 so that envelopes discharged onto conveyor 168 abut surface 176*c* of the zip kicker 176. Envelopes which are thusly stopped by zip kicker 176 have their leading edge space a distance $D_2 > D_1$ away from edge 172 of the conveyor 168. Hence, the zip kicker is useful in the grouping of envelopes by zip code. Envelopes having a first zip code are discharged onto conveyor 168 and spaced at the distance $D_1$ from edge 172. When an envelope having another zip code is encountered, the zip kicker 176 spaces the new zip code envelope from edge 172 by the distance $D_2$. Thus an operator can visibly determine the envelopes belonging to the first zip code and distinguish therefrom envelopes belonging to the second zip code.

The FIG. 1 embodiment of the insertion machine 100 also has included therewith logic circuitry 180 which has output ports connected by means of eleven electrical lines 182*a* through 182*k* to corresponding stations 152*a* through 152*k*. In this regard, the means of the station 152*a* through 152*j* which enables the feeding means at that station to pull an insert from the station's hopper is connected by the appropriate line 182 to the logic circuitry 180. The logic circuitry 180, known in the prior art, is adapted to latch input data information to shift register means. The latching means and shift register means are operated in timed relation with the cycle of the main drive shaft of the insertion machine 100.

The information storage means 102 of the inserter machine system of the embodiment of FIG. 1 includes a digital tape transport 200; a first formatter 202; and, a buffered formatter 204. In the embodiment of FIG. 1 the tape transport 200 is of a type such as a Kennedy Company Model 9000 (Part No. 192-9000-159) which handles nine track, 800/1600 BPI density tape at a speed of about 37.5 IPS. This particular tape transport is described in an Operation and Maintenance Manual published by Kennedy Company.

In the embodiment of FIG. 1 the first formatter 202 is of a type such as Kennedy Company Model 9218 and the buffered formatter 204 is of a type such as the Kennedy Company Model 9217B. The structure and operation of the respective formatters 202 and 204 are sufficiently described in the respective publications of the Kennedy Company entitled Operation and Maintenance Manual. The cables 204*a* and 204*b* interfacing the tape transport 200 to the first formatter 202, and the cables 206*a* and 206*b* interfacing the first formatter 202 to the buffered formatter 204 are standard cables provided by Kennedy Company and readily understood from the manuals mentioned above.

The printing means 104 of FIG. 1 has a planar tabletop 230 which has essentially sub-table surface troughs 232*a* and 232*b* formed therein. In each trough 232*a* and 232*b* are mounted rotating rollers 234*a* and 234*b*, respectively, which have portions of their cylindrical peripheries extending above the plane of the tabletop 230 to propel envelopes passing thereover in the direction of arrow 236. A belt-like conveying means 238 also helps to transport envelopes in the direction of arrow 236.

Located on the tabletop 230 of the printing means 104 are an envelope supply means or hopper 250; a vertically extending housing 251; an ink jet printer head 252; shuttle means 254 which reciprocates back and forth in the direction of arrow 255 for extracting and feeding bottom-most envelopes in hopper 250 under the housing 251 and to the printer head 252; printer electronics including printer motherboard 256; and, a keyboard 258 mounted on housing 251. The embodiment of the printer head 252 of FIG. 1 is a Bell & Howell Ink Jet Addressing Machine (Model 96-1-E). The manner in which the printing means 104 is adapted to receive data is understood with reference to Bell & Howell publications entitled I/J System 96 Parallel Interface Connection Manual and T/C System 96 Operator's Manual.

The envelope supply means 250 is a bottom-feeding hopper wherein envelopes are loaded face up. When shuttle means 254 reciprocates to a leftmost "home" position as shown in FIG. 1 envelopes can be loaded thereon from the hopper 250. Once the loaded shuttle 254 reciprocates rightwardly and under housing 251, the roller 234*a* cooperates with belt 238 to convey the envelope from the shuttle means 254 to the printer head 252. Disposed above the tabletop 230 along the envelope's path of travel from shuttle means 254 to the printer head 252 at a sufficient clearance to permit an envelope to travel thereunder are a plurality of elongate guide members 258. A shuttle home detector 260 is positioned to detect when the shuttle means 254 is in the "home" position as described above. The shuttle home detector 260 is, in the illustrated embodiment, a Honeywell 2001 photo interrupter. Beneath the tabletop 230 and looking up between guide members 258 is photodetector means 262 which respond with a low electrical signal when covered by an envelope in transit from the hopper 250 to the printer head 252.

The roller 234*b* conveys envelopes discharged from the printer head 252 to the BAT 106. Disposed above the tabletop 230 along the envelope's path of travel from the printer head 252 to the BAT 106 at a sufficient clearance to permit an envelope to travel thereunder are a second set of elongate guide members 263.

The electrical components associated with the printing means 104 are connected by suitable electrical connectors to the printer electronics. In this regard, the envelope hopper and shuttle means are connected by cable 264 to the motherboard 256 while the printer head 252 is connected by cable 266 to motherboard 256.

The buffer and turnover assembly (BAT) 106 comprises an envelope receiving buffer 300 and means for introducing an envelope onto conveyor 126. The means for introducing an envelope onto conveyor 126 includes a pair of motion-imparting rollers 302*a*,302*b* and an envelope turnover device 304. The pair of rollers include an upper roller 302*a* and a lower roller 302*b* directly beneath roller 302*a* in FIG. 1 where it is hidden from view. Most of the lower roller 302*b* is under the plane of the table 301 and is located so that an envelope discharged from the printer head 252 will have its leading edge in contact with the continuously rotating lower roller 302*b*. Although the mechanical structure is not illustrated in detail in FIG. 1, it should be understood that the upper roller 302*a* is adapted to selectively move toward and away from the plane of the table 301 for selective contact with an envelope positioned between the two rollers 302. The upper roller 302*a* is not driven but has free-wheeling bearings. The lower roller 302*b* rotates in the clockwise direction (the direction shown by arrow 306) so that envelopes nipped therebetween are propelled in the direction of arrow 308.

As mentioned before, the envelope receiving buffer 300 is adapted to receive envelopes discharged from the printer 252. As envelopes move into and out of the envelope receiving buffer 300 the envelopes cover and uncover a buffer first photodetector 310 and a buffer second photodetector 312. In this regard, the first and second photodetectors 310 and 312 are situated slightly below the plane of table 301 so that they may be covered and uncovered as envelopes enter and leave the envelope receiving buffer 300.

In the vicinity of the envelope turnover assembly 304 the transport table has three sub-table slots 318 across the width thereof. The envelope turnover assembly 304 comprises a pivoting header member 320 having an axis of rotation 322. Three arms 324 aligned with slots 318 extend orthogonally from the header 320 and thus extend essentially across the width of the transport table 301. The header 320 and three arms 324 integral therewith are adapted to rotate an essentially 180° range of motion. That is, from its rest position wherein arms 324 are accommodated below the plane of the transport table 300, the header 320 and arms 324 rotate essentially upwardly out of the plane of the table 301, about axis 322, and back into the plane of FIG. 1 over a portion of the conveyor 126, and then back to the position shown in FIG. 1. Rotation of the turnover assembly 304 about axis 322 is in timed relation with the operation of the inserter machine. In this respect, although not specifically shown, it should be understood that suitable mechanical linkage exists between the turnover assembly 304 and the main drive shaft of the inserter machine.

The header 320 and arms 324 of the turnover assembly each have a vacuum manifold (unillustrated) formed therein connected to a suitable source of vacuum. The vacuum manifolds communicate with sucker cups 340 mounted on the upper side of the arms 324. Unillustrated means are provided for controlling the application of a vacuum to the manifolds. The creation of a vacuum in the manifolds of the turnover assembly 304 causes the envelopes to be temporarily secured to the turnover assembly, which receives the envelopes from the envelope-receiving buffer and turns them over onto conveyor 126.

A turnover assembly photodetector 350 is positioned above the plane of the transport table 301 and is pointed downwardly at an angle of approximately 45° onto the plane wherein the turnover assembly arms 324 lie. So positioned, the photodetector 350 is able to detect the presence of an envelope which lies between the photodetector 350 and arms 324 of the turnover assembly. In this regard, a turnover assembly driving shaft interrupt photodetector 360 is situated to detect the positional status of the driving shaft of the turnover assembly.

The data processing means 108 comprises a computer 400 to which a standard monitor 402 is connected by a cable 404 in conventional manner. In the embodiment illustrated, the computer 400 is a Bell & Howell 48K Apple II Plus computer, the structure and operation of which are described in a publication entitled *Apple II Reference Manual*. The computer 400 has a keyboard 406 and a main board 408 (shown in broken lines in FIG. 1). A microprocessor chip 410 is mounted on the main board 408 and, in the illustrated embodiment, is a SYNERTEK/MOS 6502 microprocessor. A plurality of peripheral slots are provided on the backplane portion of the main board 408. In order to interface the computer 400 with the information storage means 102, the printer means 104, the BAT 106, and the inserter machine 100, two special peripheral cards or interface cards 412 and 414 are inserted into the peripheral slots. In particular, interface card 412 is inserted into slot 5 of the particular computer 400 illustrated, while interface card 414 is inserted into the slot 2 thereof.

Figure 3:
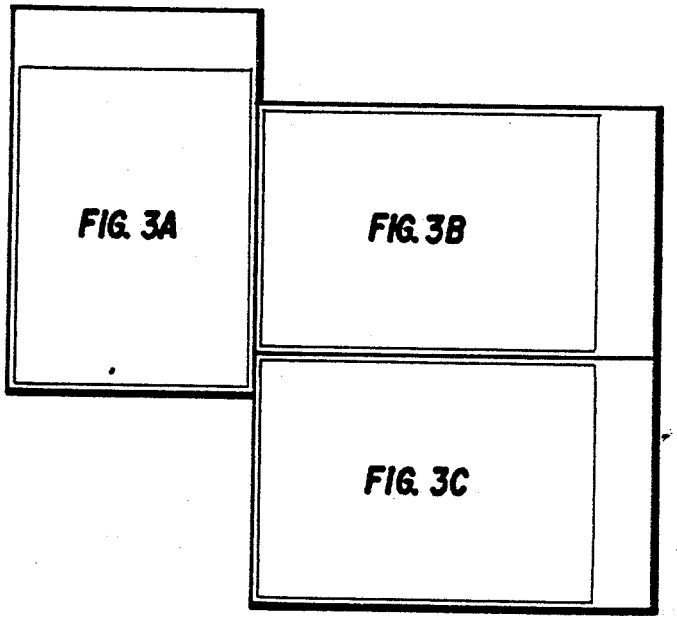
FIG. 3 is a schematic diagram showing the relationship of FIGS. 3A, 3B and 3C.
Figure 2A:
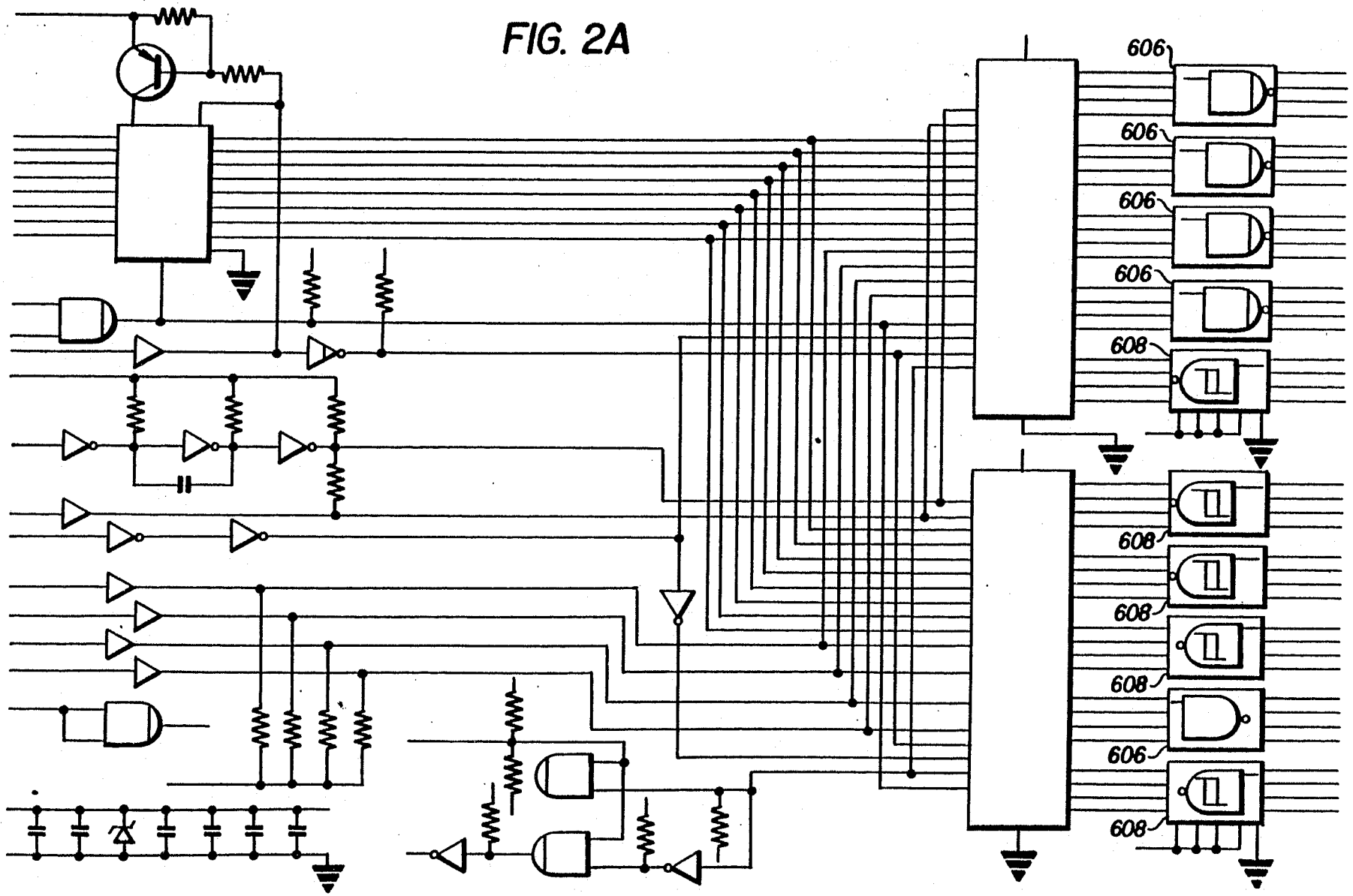
FIGS. 2A, 2B and 2C are schematic diagrams showing the circuitry of a digital interface circuit board of an embodiment of the invention.
Figure 2B:
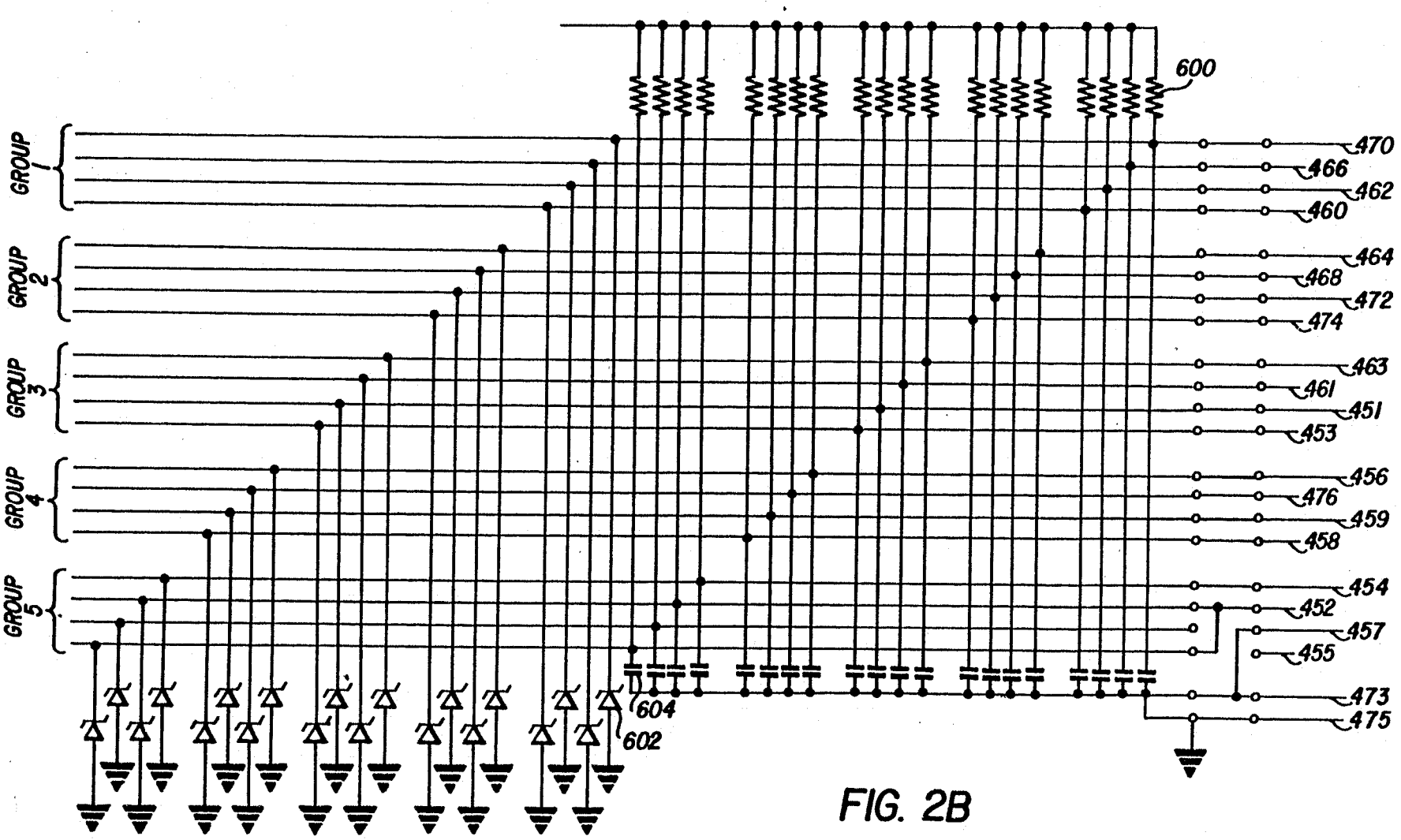
Figure 2C:
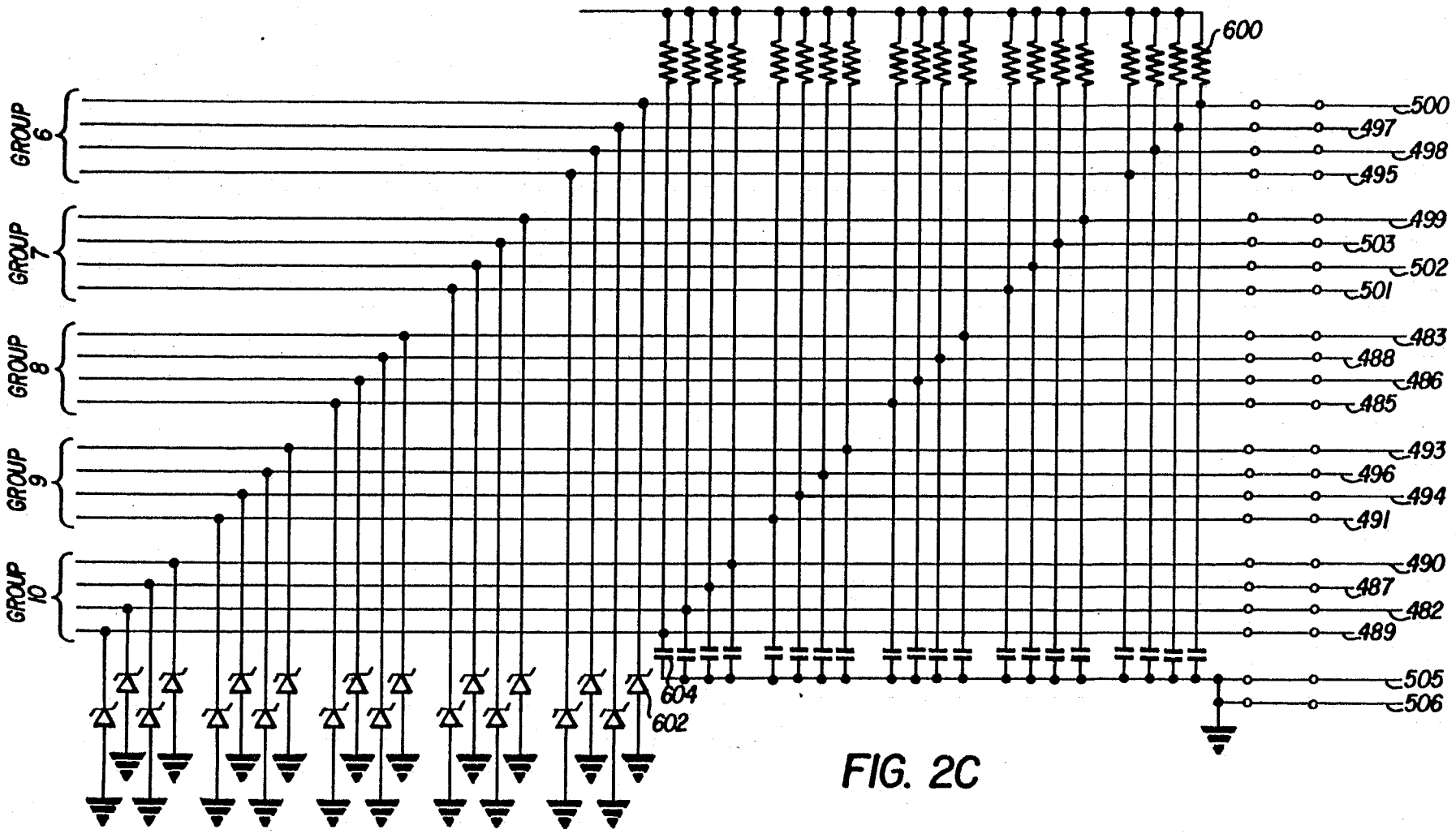
Figure 3A:
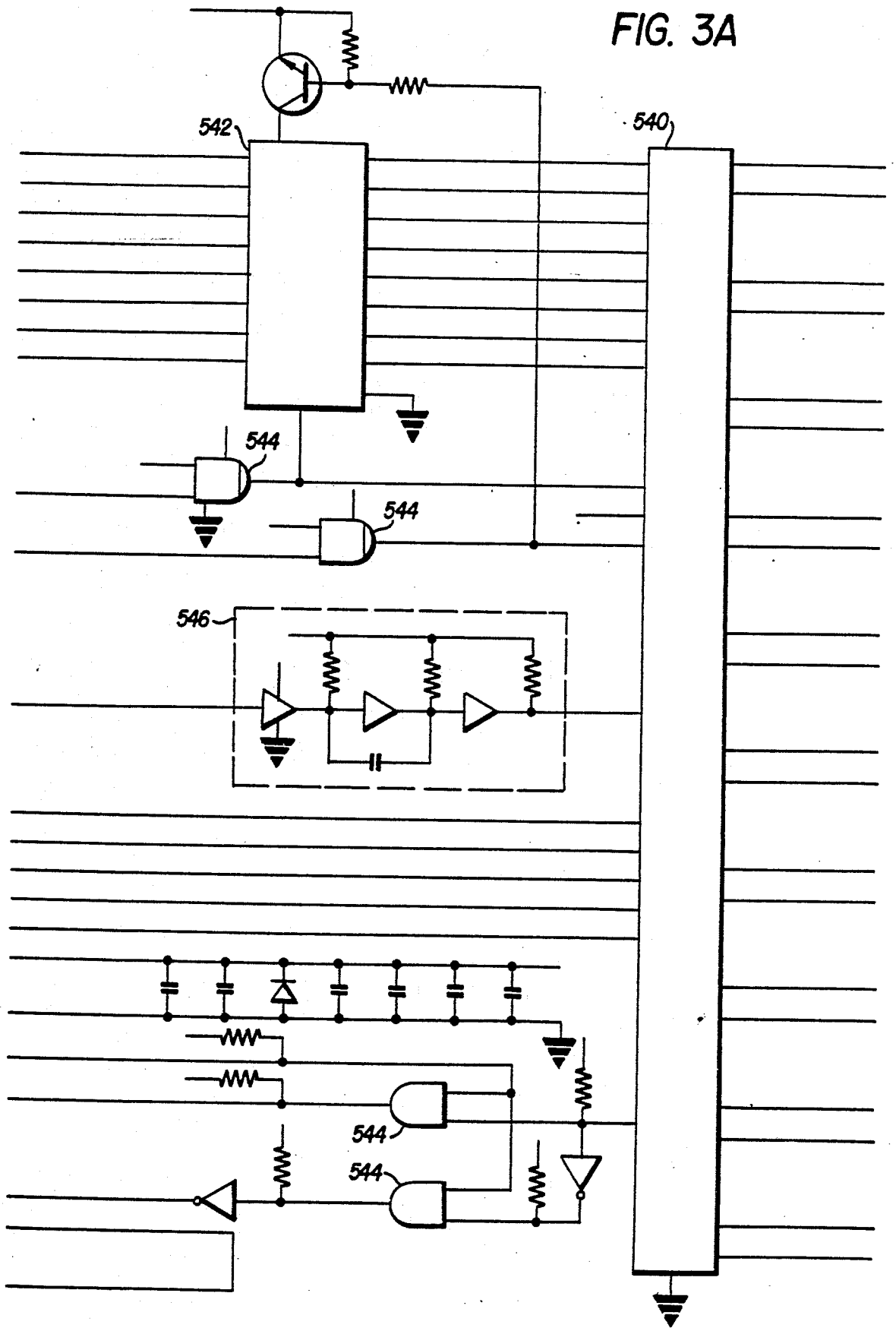
FIGS. 3A, 3B and 3C are schematic diagrams showing the circuitry of an optical isolator circuit board of an embodiment of the invention.
Figure 3B:
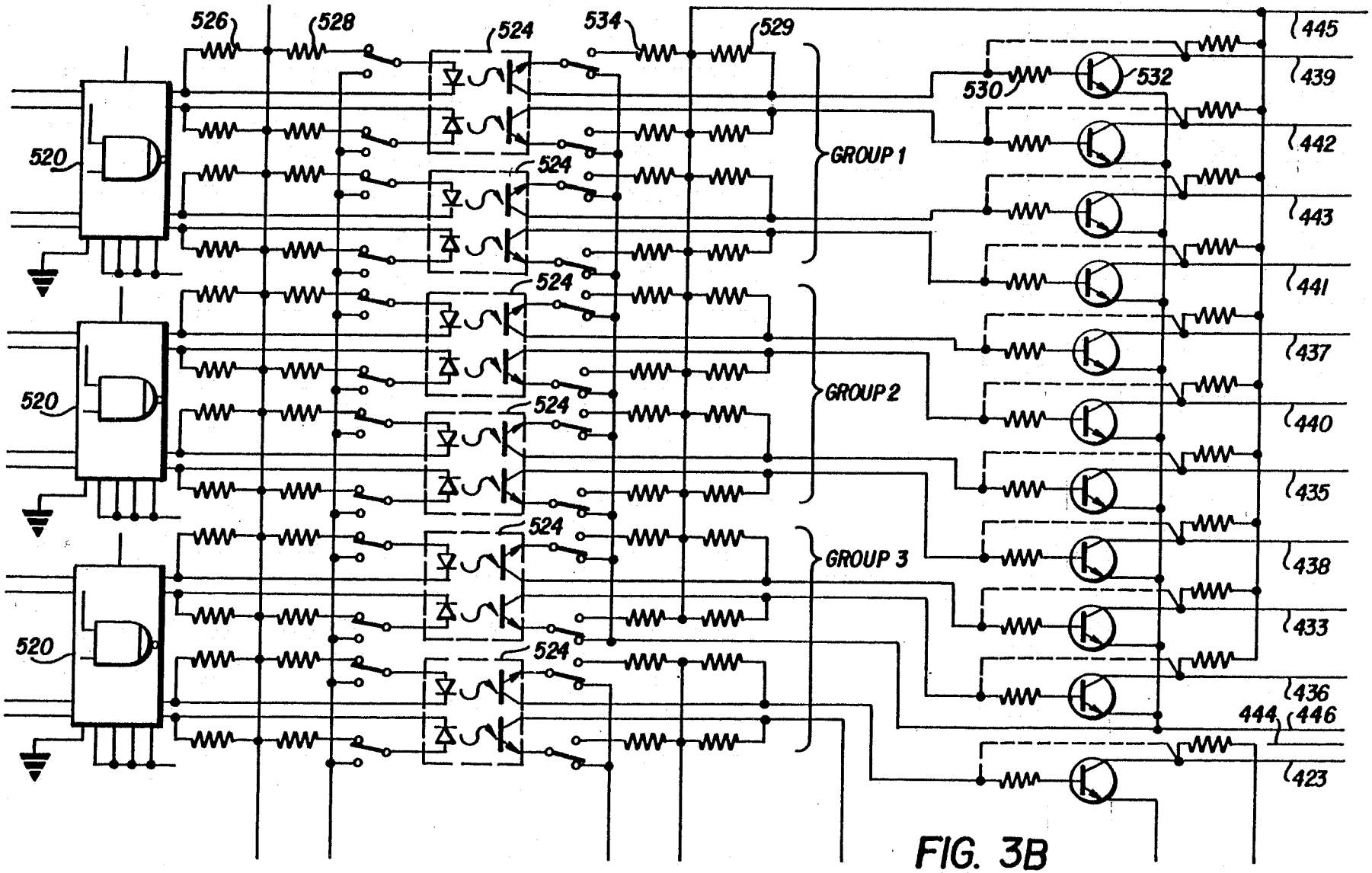
Figure 3C:
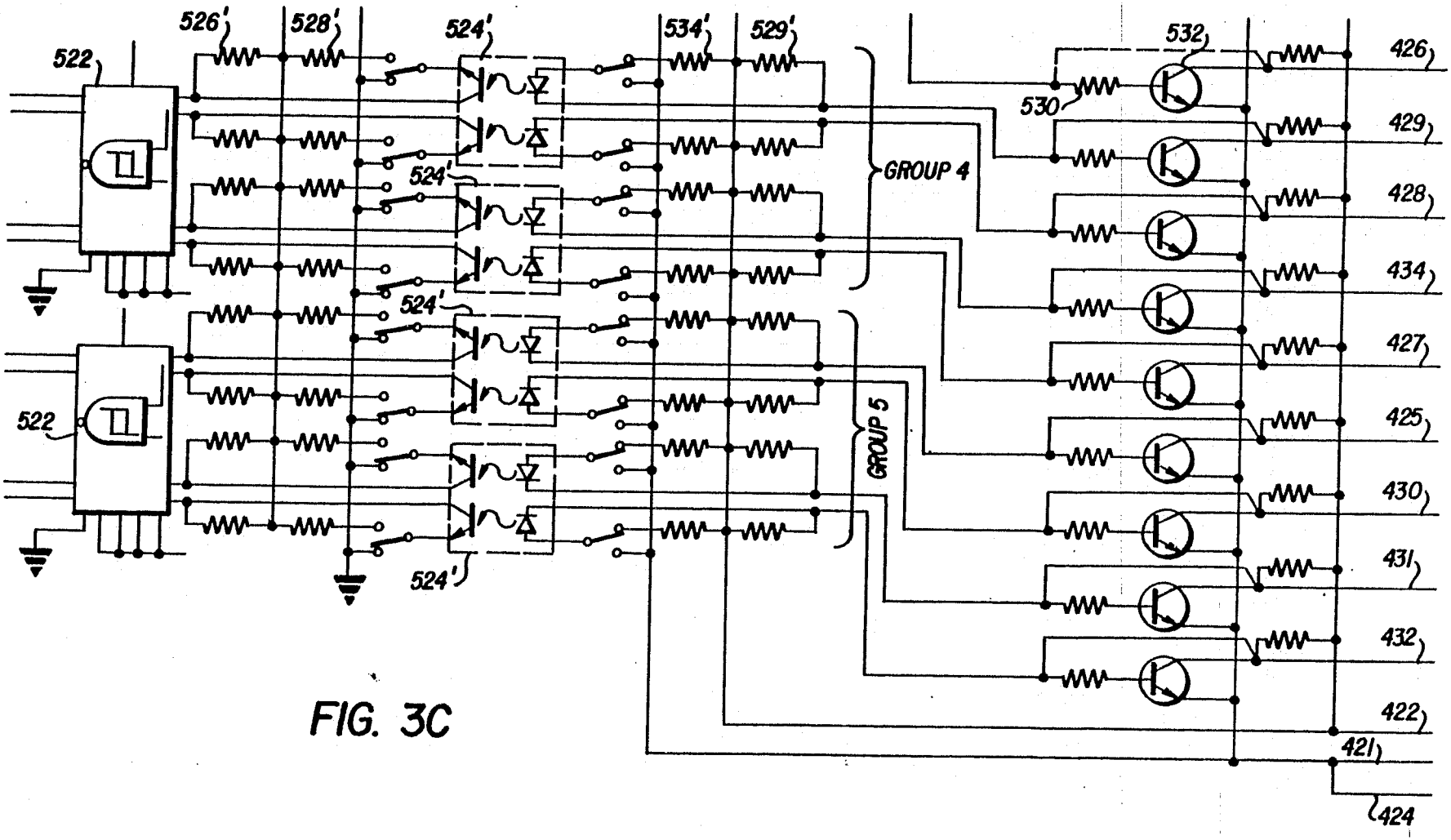

Interface card 412, known as the optical isolator or optical interface card, primarily allows the computer 400 to interface with the BAT 106 over a line ribbon connector 420. The leads in the ribbon connector cable 420 are understood from the following description of corresponding connector pins of interface board 412 as shown in FIG. 3:

CONNECTORS FOR OPTICAL ISOLATOR CARD

| Pin | Identification |
|---|---|
| 421 | External Ground #2 |
| 422 | External Power #2 |
| 423 | Insert Station #8 |
| 424 | External Ground #2 |
| 425 | Photodetector 350 |
| 426 | Insert Station 9 |
| 427 | Photodetector 312 |
| 428 | Photodetector 262 |
| 429 | Shuttle Home Detector 260 |
| 430 | Inserter Data Request |
| 431 | Inserter Data Request |
| 432 | Inserter Data Request (tied to pin 430) |
| 433 | (Unconnected) |
| 434 | Photodetector 310 |
| 435 | Insert Station 6 |
| 436 | Zip Kicker Station |
| 437 | Insert Station 4 |
| 438 | Insert Station 7 |
| 439 | Insert Station 0 |
| 440 | Insert Station 5 |
| 441 | Insert Station 3 |
| 442 | Insert Station 1 |
| 443 | Insert Station 2 |
| 444 | External Ground #1 |
| 445 | External Power #1 |
| 446 | External Ground #1 |

The interface card 414 in slot 2, also known as the digital interface card, is connected to the printer 104 by a 26-line ribbon connector 450. Ribbon connector 450 allows the computer 400 to interface to the external printer 104 in parallel data format. The identification of the 26 lines in the ribbon connector 450 are seen with reference to the following listing of corresponding connector pins on card 414 as seen with reference to FIG. 2:

CONNECTIONS FOR DIGITAL INTERFACE CARD (TO PRINTER)

| Pin | Identification |
|---|---|
| 451 | Data Busy |
| 452 | Start |
| 453 | Print Label |
| 454 | Label Printed |

-continued

| CONNECTIONS FOR DIGITAL INTERFACE CARD (TO PRINTER) | |
|---|---|
| Pin | Identification |
| 455 | Printer +5 V |
| 456 | EOF-Reset |
| 457 | Printer Ground |
| 458 | Shuttle Enable |
| 459 | Bad Data |
| 460 | Data Bit 3 |
| 462 | Data Bit 2 |
| 464 | Data Bit 4 |
| 466 | Data Bit 1 |
| 468 | Data Bit 5 |
| 470 | Data Bit 0 |
| 472 | Data Bit 8 |
| 473 | Printer Ground |
| 474 | Data Bit 7 |
| 475 | Ground |
| 476 | Data Strobe |

The lines in connector 450 corresponding to Pins 461, 463, 465, 467, 469 and 471 are not connected to the computer 108 and are grounded at the printer 108.

Yet another 26-line ribbon connector, ribbon connector 480, connects the digital interface card 414 in slot 2 of computer 400 to the electronic storage means 102, and particularly to the buffered formatter 204. The lines included in the ribbon connector 480 are understood with reference to the following listing of corresponding pin identifications given with reference to digital interface card 414 seen in FIG. 2:

| CONNECTIONS FOR DIGITAL INTERFACE CARD (TO INFORMATION STORAGE MEANS) | |
|---|---|
| Pin | Identification |
| 483 | Read Strobe |
| 485 | Read Block Error |
| 486 | Formatter Busy |
| 488 | Read EOF |
| 489 | Read EOR |
| 490 | Read Data Available |
| 491 | Backup One Block |
| 493 | Search One Block |
| 494 | Backup One File |
| 495 | Data Bit 4 |
| 496 | Read Out One Character |
| 497 | Read Data Bit 6 |
| 498 | Read Data Bit 5 |
| 499 | Read Data Bit 3 |
| 500 | Read Data Bit 7 |
| 501 | Read Data Bit 0 |
| 502 | Read Data Bit 1 |
| 503 | Read Data Bit 2 |
| 505 | Ground |
| 506 | Ground |

Pins 481, 482, 484, 487, 492, and 504 are either not connected or are not germane to this invention.

Referring back now to the optical interface card 412 as seen in FIG. 3, the card 412 has 20 selectable lines for input or output. The lines are configured in groups of four: group 1 comprises lines 439, 442, 443, 441; group 2 comprises lines 437, 440, 435, and 438; group 3 comprises lines 433, 436, 423, and 426; group 4 comprises lines 429, 428, 434, and 427; and, group 5 comprises lines 425, 430, 431, and 432. The lines of group 1, group 2, and group 3 concern outputs, each group having a driver 520 associated therewith. The lines of group 4 and group 5 concern inputs, each group having a Schmidt trigger 522 associated therewith. In the illustrated embodiment, the drivers 520 are 7401 TTL drivers and the Schmidt triggers 522 are 74132 devices.

Each group of four lines on the optical isolator card 412 is further subdivided into two pairs of lines. Each pair of lines share an opto-isolator device. In particular, each pair of output lines share opto-isolator 524 while each pair of input lines share an opto-isolator device 524'. In this regard, input opto-isolators 524' are rotated 180° in relation to the output opto-isolators 524.

For each line in groups 1, 2 and 3 the opto-isolator 524 is set with a 2K pull-up resistor 526 to +5 V and a 220 ohm resistor 528 from the cathode of the LED of opto-isolator 524 to +5 V. On the output side of the opto-isolator 524 the collector of each phototransistor is jumpered to ground and the emitter is pulled up through a 1K resistor 529 to external power (line 445). The output is then passed through a 220 ohm resistor 530 to the base of a power transistor 532 or by a jumper and exclusion of the transistor 532 to the appropriate pin.

With respect to the input lines of groups 4 and 5 of the optical isolator card 412 of FIG. 3, input comes from the 26 line ribbon cable 420 through a jumper bypassing the excluded output transistor 532 into the anode of the LED of the opto-isolator 524'. The anode of the LED of each opto-isolator 524' is pulled to external +12 V through a 1K ohms resistor 529' and the cathode of the LED is tied to the external 12 V (line 422) by a 220 ohm resistor 534. The output of the collector of the phototransistor of the opto-isolator 524' is tied to ground and the emitter is pulled up to the computer +5 V through a 2K resistor 526' and goes into an input of the Schmidt trigger 522.

The four input pins of each driver 520 and the four output pins of each Schmidt trigger 522 on the optical interface card 412 are connected to appropriate pins of a parallel I/O chip 540. In this illustrated embodiment I/O chip 540 is a Rockwell 6522 versatile interface adapter (VIA). Other than pin connections to +5 V and to ground, the remaining pins of chip 540 are connected to standard interface circuitry for interfacing the optical interface card 412 to Apple bus. The standard interface circuitry includes a bidirectional bus driver chip 542 (such as a DP8304B device); buffering I/O devices 544; and, phase changing circuitry as framed by broken lines 546.

Figure 2:
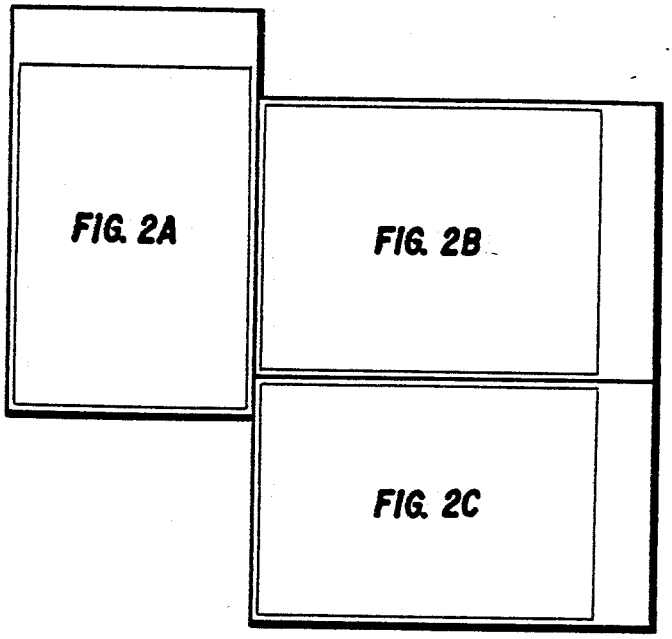
FIG. 2 is a schematic diagram showing the relationship of FIGS. 2A, 2B and 2C.

Referring now to the digital interface card 414 of FIG. 2, card 414 is adapted to connect to both the 26 line ribbon cable 450 and the 26 line ribbon cable 480. Of the 26 lines in cables 450 and 480, 20 lines of each cable are selectable for input or output. All input and output lines on card 414 have a 10K ohm pullup resistor 600 to the computer +5 V line; a 5.1 Zeener diode 602 to computer ground (to suppress noise spikes and protect drivers); and, provisions for optional bypass capacitors 604 (also to suppress transient pulses). Each output line is driven by a open collector driver 606, such as a 7401 device. Each input line is buffered by a Schmidt trigger 608 such as a 74132 device. As shown in FIG. 2, the lines are set in groups of four as either input or output lines. Of the ten groups shown in FIG. 2, groups 1, 2, 3, 4, and 9 are groups having output lines, while groups 5, 6, 7, 8, and 10 are groups having input lines.

Cable 420 has a header 650 at its BAT end which is connected to header 652 of a cable 654 housed in the BAT 106. Thirteen lines of cable 654 corresponding to insert station data lines 442, 443, 441, 437, 440, 435, 438, 423, 426, 439, 436 and inserter data request lines 430, 431 of cable 420) branch off to form a cable 656 which terminates at header connector 658. A further cable 660 connects header 658 of cable 656 to a connector header 662 of a cable 664. Cable 664 is connected to the logic circuit 180 of the insertion machine 100.

The remaining lines of cable 654 which do not branch to form cable 656 are connected to various apparatus on the BAT 106 or on the printing means 104. In this respect, a line 670 is connected to photodetector 350; line 671 is connected to photodetector 312; line 672 is connected to photodetector 310; line 673 is connected to photodetector 262; and, line 674 is connected to the shuttle home detector 260.

The storage medium handled by the tape transport 200 of the embodiment of FIG. 1 is formatted so that the printer head 252 will print on envelopes passing thereby an envelope address (framed by the broken lines indicated generally by reference numeral 700) as seen in FIG. 7. Envelope address 700 includes eight print lines numbered consecutively from line 701 to 708 inclusive. Within the envelope address 700, the first two lines 701 and 702 serve a special purpose as discussed hereinafter. The remaining lines (lines 703 through 708) are available for providing conventional address data, such as the addressee's name (line 703), the addressee's title (line 704), the addressee's company affiliation (line 705), the addressee's street address (line 706), and the addressee's town and state (line 707). It should be understood that the format of lines 703 through 708 of the envelope address 700 as shown in FIG. 7 is just one example of an appropriate format and that appropriate variations thereof are well understood. For example, in some applications the information provided on lines 704 and 705 as shown in FIG. 7 are not necessary, in which case line 703 would contain street address information while line 704 would contain information relative to the addressee's city and state.

Line 702 of envelope address 700 appears on every envelope printed by the printer head 252 and is essentially a print line comprising the consecutive alphanumeric characters "1", "2", "3", "4", "5", "6", "7", "8", "9", "0", and "Z". Each character corresponds to selected operating stations of the insert machine 100. In particular, numeral "1" on line 702 corresponds to insert station 1 (station 152*a*), numeral "2" corresponds to insert station 2 (station 152*b*) and so forth to numeral "0" for insert station 10 (station 152*j*) and letter "Z" for the zip kicker station.

Above certain select numerals of line 702, line 701 of envelope address 700 contains the numeral "1". The numeral "1" so positioned reflects that, according to information stored on the electronic storage medium with respect to the particular addressee, the corresponding insert station is to be activated and an insert pulled therefrom. For example, the numeral "1" in FIG. 7 indicated by arrow 710 indicates that insertion station 2 (station 152*b*) is to be activated for the addressee shown in envelope address 700. With further reference to envelope address 700 in FIG. 7, it should accordingly be understood that insert station 4 (station 152*d*), insert station 5 (station 152*e*), and insert station 6 (station 152*f*), as well as the zip kicker station are to be activated with respect to the addressee shown in FIG. 7. The line 701 of envelope address 700 also contains a plurality of digits which are used as an addressee serialization or sequence number. In FIG. 7 six such digits are bracketed and collectively given reference numeral 712.

Each of the lines 701 through 708 of FIG. 7 are shown to have the letters "CR" and "LF" at the end thereof, each of these two-letter codes being illustrated in broken lines. As an example, in line 701 arrow 714 points to the code "CR" which is formed with broken lines and arrow 716 points to the code "LF" which is also formed with broken lines. These broken line codes do not appear in the actual envelope address 700 as printed by the printer head 252, but are illustrated with respect to FIG. 7 only to better explain in conjunction with FIGS. 4 and 5 the necessary format for the information storage medium in order for the printer head 252 to function correctly. In this regard, the code "CR" indicates a "carriage return" and the code "LF" indicates a "line feed". With respect to the format of the information storage medium, every address line must end with a "CR" "LF" combination to indicate to the printer 104 that the next group of characters on the tape is to be printed on another line. Further, the "CR" "LF" combination of the last line of each address block is followed with an additional "LF" code such as that indicated by arrow 718 in FIG. 7. The additional "LF" code as indicated at 718 signals the end of an envelope address 700.

Figure 4:
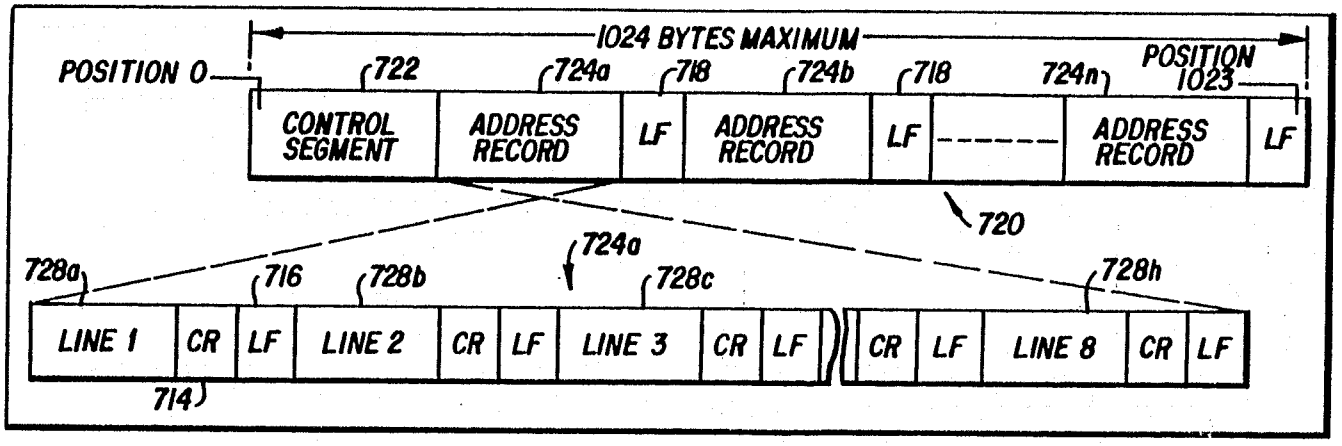
FIG. 4 is a diagram showing the format of information storage medium according to an embodiment of the invention.
Figure 5:
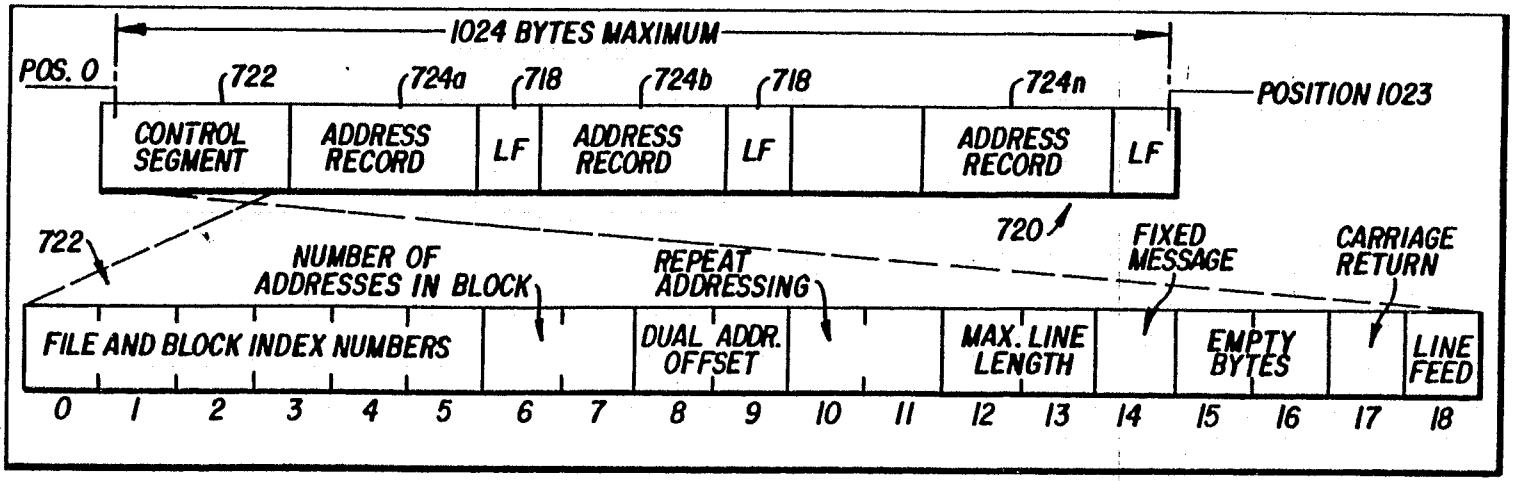
FIG. 5 is a diagram showing the format of a control segment of information storage medium according to an embodiment of the invention.

In the illustrated embodiment the information storage medium comprises magnetic tape 720. It should be understood, however, that in other embodiments different forms of information storage mediums, such as magnetic or optical discs, for example, are utilized. A portion of a block of tape 720 is shown in FIGS. 4 and 5. In a preferred embodiment the tape is nine track IBM 2400 series-compatible tape. Depending on the model of tape deck used, each tape should be recorded with a density of 800 BPI or 1600 BPI. The 800 BPI density best corresponds to the NRZ1 recording method; the 1600 BPI density should be used in conjunction with the PE (Phase Encoded) method.

In the illustrated embodiment the maximum block size on tape 720 is 1024 bytes, where a byte contains one character. While the characters on tape 720 may be recorded and read according to either the EBCDIC code or the ASCII code, in the following discussion of the illustrated embodiment it is assumed for convenience that the EBCDIC code is used.

The first 19 byte positions of each block comprise a control segment 722 which includes processing instructions for the printer 104. The format of each control segment 722 is shown in FIG. 5. Physically appearing on tape 720 after the control segment 722 are a plurality of address records 724*a*, 724*b*, . . . 724*n*. The format of each address record 724 is seen in FIG. 4. The number of address records n is determined by the size of the address records included within the block, the total number of bytes per block of the illustrated embodiment of the tape 720 being 1024 bytes maximum. Two neighboring address records 724 are separated by a one byte character (indicated by arrow 718) which corresponds to the "LF" or "line feed" code discussed above.

Turning now to FIG. 5, the first six bytes of control segment 722 (bytes 0–5) contain characters representative of the file and block index numbers. The file and blocks index numbers allow an operator using the printer keyboard 257 to process a given file and block of addresses on demand rather than having to print an entire tape in sequence in order to locate the desired address information. Characters in byte positions 6 and 7 indicate the number of address records 724 included in the particular block. Other parameters specified within the control segment 722 and discussed further hereinafter are a dual address offset capability (byte positions 8 and 9), a repeat addressing capability (byte positions 10 and 11); and the maximum line length (i.e. the maximum number of characters on a print line) (byte positions 12 and 13). Byte position 17 contains a character corresponding to the "CR" code while byte position 18 contains a character corresponding to the "LF" code.

In the above regard, the two characters in byte positions 8 and 9 of the control segment 722 which concern the dual address offset feature are used whenever it is desired to repeat an address on the same piece of media. This feature is particularly helpful when printing such items as subscription fulfillments, return orders, address correction requests and the like. The two characters in byte positions 8 and 9 define the distance between two identical addresses which are printed on one document, such as an envelope. The value of the two characters in byte positions 8 and 9 are derived through a formula which the data processing means 108 will interpret as the desired spacing distance in bytes. FIG. 8 illustrates the dual-address offset value formula which is:

$$DA=(DBL-LL)-7$$

wherein

DA=the dual address offset value (to be supplied in byte positions 8 and 9 of control segment 722)

DBL=the desired distance betwen the left margins of the two addresses (that is, the left address and the right address)

LL=line length (as stated in byte positions 12 and 13 of control segment 722).

If, as in FIG. 8, the desired distance DBL between the left margins of the addresses is 45 bytes and the line length LL is defined as 30 bytes, the resulting distance between addresses will be 15 bytes. According to the formula, the dual-address offset value stored in byte positions 8 and 9 of control segment 722 will be 8. If the dual-address offset value in byte positions 8 and 9 of control segment 722 is one digit, byte position 8 should contain a zero, and byte position 9 should contain the formula value. If no dual-address offset option is desired, both byte positions 8 and 9 are coded with zeros.

The two characters in byte positions 10 and 11 of control segment 722 provide a repeat addressing capability for printing an individual address on several pieces of media such as, for example, church donation envelopes, peel-off labels, bank-by-mail envelopes, and return address requirements. In particular, the characters in byte positions 10 and 11 indicate the number of additional copies of each address record 724 which are to be printed, each of the copies being printed on a separate document or envelope. If both byte positions 10 and 11 are coded as zeros, no additional copies beyond one original will be made. If two printings of each address are desired, the user should code byte positions 10 and 11 with a zero and a one, respectively, which will result in one original, plus one copy, equaling two printings. In other words, since a zero coding results in one printing, the user should always code in one less than the number of printings desired. Since the maximum number of copies which may be requested is 99, the maximum number of printings per record is 100.

The two characters in byte positions 12 and 13 of control segment 722 define the maximum address width (line length) in character bytes. This value is held constant throughout the block having as particular control segments 722. Of course the lines in each individual address record 724 may contain less than the specified number of characters, but the printer means 104 will compensate by automatically adding space characters to fill in each line to the set length. As can be surmised from the above, the length value is important in defining margins for the dual address offset option (described above with reference to byte positions 8 and 9 and FIG. 8) to make certain that both left and right addresses will fit on the desired document.

The one character in byte position 14 of control segment 722 instructs the printer 104 whether or not to add a fixed message to all address records 724 on a block. A "1" character in byte position 14 indicates a fixed message should be included; a "0" character indicates no message is desired. The fixed message feature can be utilized for advertising reminders, seasonal greetings, occupant or current resident notations, return address repetition, fixed billing information, fixed title or job headings, list processing data, and fixed city/state material, for example.

With further regard to the fixed message option described in connection with byte 14 of control segment 722, if a fixed message is not indicated, the memory of the printer 104 is erased between each address record. When a fixed message is indicated, the memory of printer 104 is not erased. As a new address record is loaded into the printer memory data buffer, its characters are written over the characters of the preceding record. That is, each character replaces the previous record character contained in the same position. If characters are not replaced, they will be repeated with the new address record. This procedure allows a fixed message to be repeated throughout a tape.

To initialize a fixed message such as that described in connection with the fixed message option of byte 14 of control segment 722, a block containing only one record should be entered. In the control segment of this block, a fixed message should not be indicated (that is, a "0" character should be coded in byte position 14 of the control segment). The record should contain only the fixed message, set in the desired position for printing when included with address material. The rest of the block should be left blank. This procedure will effectively erase material left in the printer memory from the previous address record; no address material will be inadvertently attached to the fixed message. After completing initialization procedure, a fixed message indicator (a "1" character in byte position 14) should be coded into the following control segments 722 where the prescribed message is desired. If the message is to be printed with more than the immediately following block, the block should be consecutive; otherwise, the message will have to be reinitialized for later blocks, as it will have been erased.

FIG. 4 illustrates the physical format of each address record 724 on the tape 720. A first field 728*a* includes characters which result in the printing of lines 701 of the envelope address 700 of FIG. 7. The first byte of field 728*a* is a character which controls the first insert station (station 152*a*) of the inserter 100. When EBCDIC code is being utilized and a byte for a given inserter station is an EBCDIC zero or space, the corresponding insert station 152 is not activated to perform an insert pull operation. However, when the byte associated with a particular insert station is an EBCDIC 1, the appropriate insert station is activated so that an insert is pulled therefrom, or in the case of the zip divert station, a zip divert is performed. With regard to the envelope address 700 of FIG. 7, for example, the second, fourth, fifth, sixth, bytes of field 728 contain EBCDIC 1 characters to indicate that insert stations 2, 4, 5, 6, and a zip divert station are to be activated. Moreover, field 728*a*, which can include up to 58 bytes maximum, also includes a digit decimal sequence or serialization number, such as that indicated by the plurality of digits bracketed and referred to as reference numeral 712 in FIG. 7. In the field 728*a* of the tape 720 (that is each first field of each address record), the digit decimal sequence number is delineated physically on the tape 720 by two EBCDIC "#" characters. The sequence of serialization number starts at "#000000#" for the first address on the tape and increments by one for each address until the last address on the tape 720. In this respect, it can be determined that the addressee whose envelope address 700 appears in FIG. 7 is the second addressee on the tape 720 which generated the printed address.

As mentioned previously, in order for the printer 104 to perform carriage return and line feed operations, the tape 720 must contain after each field 728 proper characters corresponding to the codes "CR" and "LF". Accordingly, FIG. 4 indicates that two bytes physically following field 728 in address record 724*a* are associated with the "CR" and "LF" codes, respectively, as shown by corresponding arrows 714 and 716. For the address record 724*a* of FIG. 4, it should be understood that eight such fields (fields 728*a* through 728*h*) are shown. Neighboring fields 728 are separated by two bytes, the first separating byte being a character corresponding to the "CR" code and the second separating byte being an EBCDIC character corresponding to "LF" code.

OPERATION

When it is desired to operate the inserter machine system of the embodiment described above, the operator turns on the computer 400 and loads in conventional fashion appropriate instruction sets, such as the instruction sets documented on the microfiche appendix included with the application for this patent. The particular instructions listed on the microfiche appendix are assembler instructions suitable for use with the aforementioned 6502 microprocessor. The assembler instruction set utilized with the 6502 microprocessor is described in the *Apple II Reference Manual*.

The first routine executed by the computer 400 is routine START which is illustrated in diagram form in FIG. 9. The first step 800 performed by routine START of FIG. 9 is to disable interrupts. In step 802 routine START resets a restart vector by storing appropriate hexadecimal values at three consecutive address locations corresponding to the restart vector. The routine START then initializes various I/0 ports (by initializing certain addresses such as PACMD, PBCMD, PACR, PTCR, PIER, and PBDAT) in step 804. At this point routine START turns on the CRT or monitor 402 (step 806).

Routine START of FIG. 9 then calls subroutine COMINIT at step 808 in order to initialize various communication devices. The COMINIT routine performs various initialization procedures, including initializing the I/0 ports of the logic circuitry of the printer 104 and setting various control and interrupt enable registers associated with the logic circuitry of the printer 104. The routine COMINIT also initializes I/0 command status registers IOACMD and IOBCMD for ports A and B, respectively, of the optical isolator card 412. Then, the routine COMINIT sets up various control and interrupt control registers (such as IOIER, IOACR, IOPCR, IOADAT, and IOBADT). Routine COMINIT then sets up an interrupt routine vector in an appropriate address and, before its completion, enables interrupts.

After processing returns to the routine START (FIG. 9) from the routine COMINIT, the routine START calls at step 810 of FIG. 9 a STARTUP routine. Routine STARTUP essentially clears the monitor 402 (by a call to routine CLRCRT); displays a start message; waits for a key to be pressed on keyboard 406; displays a message to "load tape on tape drive"; and, after causing an appropriate prompting message to be displayed on the monitor 402, waits for a key to be pressed on keyboard 406. Thus, the routine STARTUP essentially functions to issue various prompts on the monitor 402 to request operator action.

When processing returns to the routine START after the call to routine STARTUP, the routine START calls a "print menu" routine PMENU (step 812). When called, routine PMENU clears the screen of monitor 402 and outputs a display essentially as seen in FIG. 10. The display, entitled "Function Menu", provides the operator with a list of processing options for operation of the inserter machine system. The "Function Menu" indicates to the operator that pressing a designated key would result in a particular processing action. For example, if in response to the display of the "Function Menu" the operator presses key "T" on keyboard 406, then the data processing system 108 will effectively cause the tape mounted in the tape transport 200 to be rewound to the start of the tape. A detailed discussion of the operating steps associated with each of the operations options listed on the "Function Menu" is provided hereinafter.

After the "Function Menu" has been displayed, the routine START calls a routine ANYKEY (at step 814) so that processing may await the operator's response to the display of the "Function Menu". Once the operator has responded by pressing an appropriate key, processing exits from routine ANYKEY so that routine START may call at step 818 the routine CLRCRT to clear the screen on the monitor 402.

After the monitor screen has cleared, routine START calls routine RECIN at step 820 to obtain from the tape mounted in tape transport 200 the first record of data located on the tape. In this respect, when called, the routine RECIN first fills a buffer INBF with spaces by calling a routine CLRINBF. Then the routine RECIN sets pointers and flags associated with the buffer INBF. Thereafter, the routine RECIN causes a loop to be performed. The loop comprises the steps of checking to determine when data is ready from the storage means 102; obtaining a next character from the storage means (by using a strobe line of cable 480 corresponding to pin 483 to strobe bits onto read data lines of cable 480 corresponding to pins 495 through 503 of the interface card 414); converting the character to ASCII code; and, storing the character in the buffer INBF. Provisions are made in the routine RECIN for determining whether the character obtained is the last character in the record. If it is the last character in the record, processing jumps to further instructions wherein appropriate pointers are set with the address of the buffer INBF.

Once the first record on the tape is obtained through the processing of routine RECIN, the routine START calls a routine DSPLB at step 822 in order to display the first record on the tape. The routine DSPLB is a generalized routine which, when called, is adapted to display any record of interest. For this particular call, it is understood that the first record on the tape is to be displayed. In general, the routine DSPLB utilizes pointers set with respect to the buffer INBF to obtain the characters stored in the buffer INBF associated with the particular record of interest. The routine DSPLB searches through buffer INBF character by character looking for a "LF" "LF" character combination. In order to display the record on the screen of monitor 402, the routine DSPLB eventually filters characters associated with the carriage return "CR" and line feed "LF" codes so that these codes will not be displayed on the screen of monitor 402.

Once the first record on the tape has been displayed by the routine DSPLB, the routine START commences execution of a loop at a location corresponding to symbol 824. The first instruction in the loop is a call at step 826 to routine CMDIN. Routine CMDIN essentially functions to obtain in meaningful fashion a command corresponding to the key pressed by the operator in response to the display of the "Function Menu" on the monitor screen 402. Routine CMDIN obtains from address KBD a two-byte code indicative of the particular key pressed on the keyboard 406. The routine CMDIN then compares the value in address KBD to values stored in a table commencing at an address KEYTAB. The table commencing at address KEYTAB has 14 words associated therewith. Index register Y acts as a table counter as each address in table KEYTAB is compared to the value in address KBD. When a positive comparison is found, routine CMDIN puts the appropriate value of index register Y into address CMD as a command number. The table KEYTAB is so constructed that the first nine options displayed on the "Function Menu" of FIG. 10 correspond to respective CMD values 1 through 9, while the last four options (controls "R", "J", "P", and "Z") correspond to CMD hexadecimal values of "A", "B", "C", and "D". For example, if the operator pressed key "F" in response to the display of the "Function Menu", routine CMDIN would return a hexadecimal value 5 in the address CMD.

Having utilized the routine CMDIN in step 826 to discern the command code to be stored in address CMD, routine START then calls at step 828 routine CASECMD which provides routine START with the capability of selecting from a plurality of routines a particular routine to call to perform the operation signified by the operator by the pressing of a key on the keyboard in response to the display of the "Function Menu". In this regard, routine CASECMD basically uses the value stored at the address CMD as an index to obtain from a table commencing at address SUBTB1 an address preceding the first instruction of the appropriate routine to be entered, the appropriate routine being determined by the value in address CMD. The address immediately prior to the entry address of the selected routine is pushed on the stack of the computer so that when routine CASECMD executes a return (RTS) instruction, the next step to be executed will then be the first instruction of the appropriate routine. For example, had the operator pressed key "F" on keyboard 406, then routine CMDIN would have determined that the appropriate value for address CMD would be a hexadecimal value corresponding to 5, so that the address FWLAB-1 would be pushed on the stack. Upon execution of the return instruction of routine CASECMD processing would continue at address FWLAB. Furthermore, it is to be noted that early in its execution the routine CASECMD pushed on the stack an address corresponding to location NEXT1, so that upon return from any one of the 14 routines entered by means of table SUBTB1, processing would return to location NEXT1 of routine CASECMD. The instruction at location NEXT1 of routine CASECMD ultimately results in a return of processing to routine START where execution loops back to the instruction at address MAINL so that another call to routine CMDIN can be made in order to obtain a further command input CMD.

FIG. 9 shows the various routines which may be accessed through routine CASECMD in the manner described above. The relationship of the routine titles to the value stored at address CMD and the particular key pressed on the keyboard 406 are shown by the following chart:

| KEY (Invalid) | ROUTINE IDLE | CMP CMD=0 IDLE STATE |
|---|---|---|
| M | PMENU | CMD=1 PRINT MENU |
| < | BKLAB | CMD=2 BACK UP 1 LABEL |
| > | FWLAB | CMD=3 FORWARD 1 LABEL |
| B | BKBLK | CMD=4 BACKUP 1 BLOCK |
| F | FWBLK | CMD=5 FORWARD 1 BLOCK |
| T | REWIND | CMD=6 REWIND TAPE |
| D | DSPLB | CMD=7 DISPLAY LABEL |
| X | RESET | CMD=8 RESET |
| L | LOCAT | CMD=9 LOCATE ROUTINE |
| R | REPT | CMD=A REPEAT LAST CMD |
| P | COMROT | CMD=C PRINT OUT ROUTINE |
| Z | TSTMOD | CMD=D TOGGLE TEST MODE |

Each of the routines listed in the table above are briefly discussed herein with reference to the more detailed microfiche appendix. It should be recalled that upon return from each of the listed routines processing ultimately continues to call again routine CMDIN (unless otherwise noted) to fetch another command CMD.

ROUTINE IDLE

Routine IDLE is called when an invalid key is pressed on keyboard 406. Routine IDLE simply calls the routine OUTMES to display on the screen of monitor 402 the message: "INVALID KEY" and instructs that the "M" key be hit for the "Function Menu" to again be displayed.

ROUTINE PMENU

Routine PMENU is called when the "M" key is pressed on keyboard 406. The routine PMENU essentially functions to display on the screen of monitor 402 the "FUNCTION MENU" illustrated in FIG. 10. The processing steps associated with routine PMENU have been described above with respect to processing step 812 of the routine START.

ROUTINE BKLAB

Routine BKLAB is called when a left arrow key is pressed on the keyboard 406. Routine BKLAB effectively backs up processing by one label (address record) to display the previous label on the monitor 402. Routine BKLAB initializes flag LFFLG to the value 0 to indicate that a "LF" character has not yet been found.

Routine BKLAB then calls routine DZOUTPO to decrement the pointer at address ZOUTPO in connection with an attempt to back up one character in the buffer INBF. Routine BKLAB then determines whether it must back up to a previous block in order to obtain the previous character. If so, a call is made to routine BKBLK which is described hereinafter. Then routine BKLAB sets the pointer ZOUTPO to the last address in buffer INBF.

Whether or not routine BKBLK was called to obtain earlier data, routine BKLAB commences to look for two consecutive "LF" characters. When two consecutive "LF" characters are encountered, routine BKLAB knows that it has backed up to the end of the label which precedes the current label. In order to back up sufficiently to obtain the entire previous label, the routine BKLAB must in a similar manner look for the next earlier occurrence of consecutive "LF" characters. Once the second set of consecutive "LF" characters is encountered, routine BKLAB knows that it has backed up past the entire previous label. Routine BKLAB then sets the pointer ZOUTPO to point to the address of the previous label. A call to routine OUTMES causes the message "BACKED UP 1 LABEL" to appear on the screen of monitor 402.

ROUTINE FWLAB

The routine FWLAB is called when the right arrow key is pressed on keyboard 406. Routine FWLAB first uses the pointer at address ZOUTPO to get a character in buffer INBF. Routine FWLAB then tests whether the character obtained is a line feed (LF) character. If the obtained character is not a "LF", the pointer ZOUTPO is incremented. If, upon incrementation, pointer ZOUTPO points to the end of buffer INBF, then routine FWLAB must call routine FWBLK to get the next block on the tape. Otherwise, after incrementation of pointer ZOUTPO, processing in routine FWLAB loops back to get the next character from buffer INBF. Once a "LF" is found, routine FWLAB tests to determine whether the next character in buffer INBF is also an "LF", since two consecutive "LF" characters signifies the end of an address record. If the next character is determined not to be a "LF" character, then routine FWLAB continues looping until two consecutive "LF" characters are found. Once two consecutive "LF" characters are found, then the pointer ZOUTPO is used for the address of a new label on the tape. At that point, routine FWLAB calls routine CLRCRT to clear the monitor display. Thereafter, routine FWLAB calls routine OUTMES to display the message "ADVANCED 1 LABEL". Then a call to routine DSPLB displays on the monitor 402 the address record corresponding to the new label.

ROUTINE BKBLK

Routine BKBLK is called when the "B" key is depressed on keyboard 406. The routine BKBLK effectively backs up the tape on information storage means 102 by one block and puts data from that previous block into the buffer INBF. Routine BKBLK then executes a loop in order to back up one block on the tape. In the embodiment shown the operating constraints of the formatters 202 and 204 of storage means 102 require that the loop be executed four times in order to effectively back up one block. During each execution of the loop the routine BKBLK puts a signal on a line of cable 480 corresponding to pin 491 of interface card 414 for the tape to back up one block. The routine BKBLK checks the signal on a line corresponding to pin 486 of interface card 414 to determine if the formatter 204 is busy. If the formatter is busy, processing continues in a loop until the formatter is no longer busy. Once the loop has been executed four times, then routine BKBLK checks a line corresponding to pin 490 to determine if read data is available. If data is available, a line corresponding to pin 483 is used to strobe data out of the memory of the formatter until the formatter memory is empty. Then, if the formatter is busy as determined by a signal on a line corresponding to pin 486, processing continues in a loop until the formatter is no longer busy (until a high signal occurs on a line corresponding to pin 486). When the formatter is determined not to be busy, then routine BKBLK calls routine RECIN to obtain the first label in the previous block. Then, after appropriate calls to routine CLRCRT and OUTMES (to display the message "BACKED UP 1 BLOCK"), the routine DSPLB is called so that the first address record on the previous block of tape can be displayed on the screen of monitor 402.

ROUTINE FWBLK

Routine FWBLK is called when the "F" key is pressed on the keyboard 406. Routine FWBLK effectively brings into memory the next (forward) block on the tape. In this respect, routine FWBLK first checks address PIFR to determine whether the line connected to pin 488 on interface card 414 is indicating that the information storage means 102 has encountered an END OF FILE (EOF). If an EOF is encountered, routine FWBLK calls routine RECIN and then calls routine OUTMES to display the message "END OF FILE" on the monitor 402. If an EOF is not encountered, routine FWBLK calls routine RECIN to get a new block of information from the tape. Routine FWBLK then calls routine CLRCRT to clear the display on monitor 402, after which a call to routine OUTMES results in the message "ADVANCED ONE BLOCK" being displayed on the monitor 402. Thereafter routine FWBLK calls routine DSPLB to display the first label on the new block.

ROUTINE REWIND

Routine REWIND is called when the "T" key is pressed on keyboard 406. Routine REWIND essentially rewinds the tape in information storage means 102 to a beginning of file indicator and then displays the contents of the first label after the beginning of file indicator. In this respect, upon being called routine REWIND calls routine CLRCRT to clear the monitor in preparation for a subsequent call to routine OUTMES for the display on the monitor of the message "REWINDING TAPE". Routine REWIND then puts a signal on a line in cable 480 connected to pin 494 for backspacing the tape one file. The processing in routine REWIND continues until a determination is made based on a signal on a line connected to pin 486 that data is ready from the information storage means 102. Once data is ready, the routine REWIND calls routine RECIN to obtain the first block of data from the tape. After a call to routine CLRCRT to clear the screen of monitor 402 and a call to routine OUTMES to display the message "START OF TAPE", routine REWIND calls routine DSPLB to display on the monitor 402 the first address record (first label) at the beginning of the tape.

ROUTINE DSPLB

The routine DSPLB is called when the "D" key is pressed on keyboard 406. The routine DSPLB essentially causes the monitor 402 to display data associated with the current address record in memory (in buffer INBF). The processing steps associated with the routine DSPLB have been described above with reference to step 822 of the routine START.

ROUTINE RESET

The routine RESET is called when the "X" key is pressed on the keyboard 406. The routine RESET essentially calls an Apple diagnostic routine which is unrelated to the invention. Processing does not branch back to any of the routines described herein after a call to routine RESET.

ROUTINE LOCAT

The routine LOCAT allows the operator to key in on keyboard 406 of the data processing means 108 a character string and cause the information storage means 102 to locate on the storage medium handled thereby an address record having the sought character string. The character string can be an addressee serialization or sequence number, the name of a city, state, person, or corporation, or a zip code, for example. The input character string can include up to 255 characters. When a predesignated "wild card" character is keyed into the character string, routine LOCAT locates on the tape any character string which is identical to that keyed in with the exception of the wild card characters. In the embodiment under discussion, an asterisk (*) is such a wild card character. In an example wherein an operator is trying to locate customers having zip codes in the range 35800 to 35899, the operator need merely key in "358**". Routine LOCAT will then function to find the first address record anywhere on the tape wherein "358" comprise the first three digits of the zip code.

Figure 15:
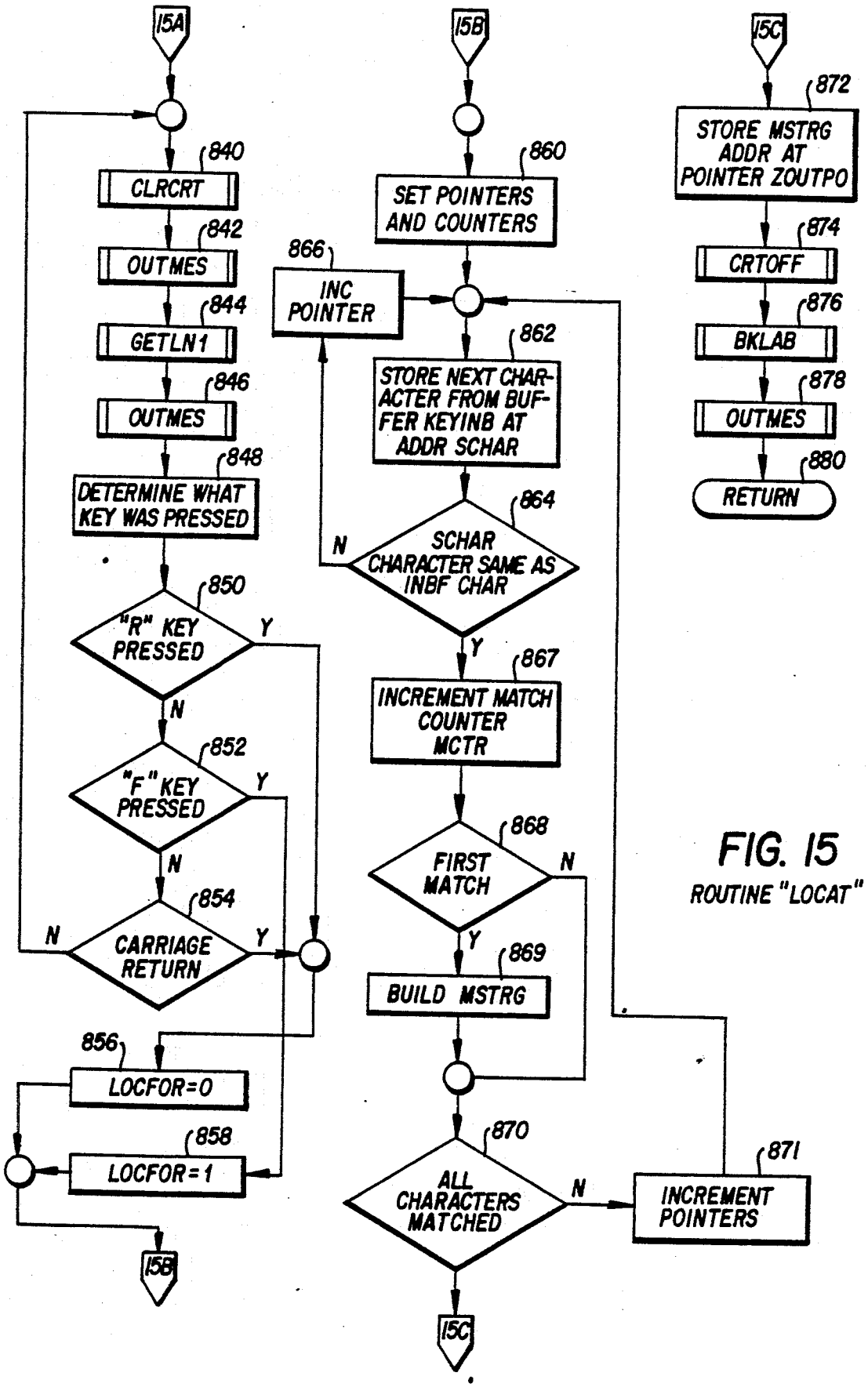
FIG. 15 is a diagram showing processing steps included in a routine LOCAT executed by data processing means according to an embodiment of the invention; and, FIG. 16 is a top view of discharge conveyor means showing envelopes positioned thereon in accordance with a mode of the invention.

Processing steps included in the execution of routine LOCAT are understood with reference to FIG. 15. The routine LOCAT, after calling routine CLRCRT (step 840) to clear the display screen of monitor 402, calls routine OUTMES (step 842) to display the prompting message "ENTER LOCATE STRING:". Having caused this message to be displayed, the routine LOCAT then calls routine GETLN1 (step 844) which stores in accordance with the plurality of keys pressed a string of characters in a buffer commencing at address KEYINB. The number of characters stored in the buffer KEYINB is stored in an address SCHL.

The routine LOCAT then calls routine OUTMES (step 846) to display on the monitor 402 the further prompt "DIRECTION? (F=FORWARD R=REVERSE)". That is, routine LOCAT inquires whether it is to start searching downstream (forward) on a tape or upstream (reverse). Routine LOCAT then checks location KBD to determine what key was pressed (step 848). If it is determined at step 850 that the depressed key was "R", then LOCAT stores the value 0 at address location LOCFOR (step 856). If, on the other hand, it is determined at step 852 that the pressed key was "F", then the value 1 is stored at address location LOCFOR (step 858). If the response were merely a carriage return (determined at step 854), then the routine LOCAT stores the value 0 at location LOCFOR to indicate a reverse direction. If any other key is pressed, processing loops back to display the original prompt message so that the extraneous key has no significance.

Once LOCAT sets the proper value for address LOCFOR, various counters and pointers are set (step 860) to facilitate further processing. In particular, a pointer at address ZPTR2 is set equal to the first address in the memory locations comprising buffer INBF. Likewise, a pointer at address ZPTR2+1 is set equal to the last address for buffer INBF. A match counter MCTR, used to determine the number of characters matched between the input string stored in a buffer beginning at address KEYINB (corresponding to the input character string) and the examined characters in the buffer commencing at address INBF, is initialized to zero. Further, a pointer at address ZPTR1 is set equal to the address of the first memory location in the buffer KEYINB while a pointer at address ZPTR1+1 is set equal to the last memory location in buffer KEYINB.

Having completed its initialization procedures and set pointers, routine LOCAT then temporarily stores the first character in buffer KEYINB at an address SCHAR (step 862). Routine LOCAT then compares the character at address SCHAR to the character in the first address of buffer INBF (step 864). If the character at address SCHAR is a wild card or if comparison indicates that the characters are the same, a match occurs. If not, then pointer ZPTR2 is incremented (step 866) and routine LOCAT loops back to check whether the character at the next address location in buffer INBF is the sought character. In this process of incrementing the pointer ZPTR2, however, a check must be made to determine whether the incremented value of ZPTR2 equals the address of the last memory location in the buffer INBF so the end of the buffer INBF will not be exceeded. If it is determined that the end of the buffer INBF is encountered, then routine LOCAT calls the appropriate routine FWBLK or BKBLK (depending on the value of address LOCFOR) to fetch another block from the tape and put its contents into the buffer INBF. Thus, either routine FWBLK or routine BKBLK puts new characters into the buffer INBF so that the new characters can be compared to the character in address SCHAR.

Once it is determined that a match exists between the character stored at address SCHAR and a character in buffer INBF at an address pointed to by the pointer at address SPTR2, then match counter MCTR is incremented (step 867). Further, it is determined at step 868 whether the preceding match was a first match If so, the routine LOCAT begins to build a string of characters beginning at address location MSTRG (step 869). If the match existed but was not the first match, then a check is made at step 870 to determine whether the number of matches made so far equals the length of the input string as indicated by the value stored at address SCHL. If the number of matches does not equal the length of the input string, then the pointers ZPTR1, ZPTR1+1, ZPTR2, and ZPTR2+1 are incremented at step 871 before routine LOCAT loops back to compare the character at the next address in buffer INBF to the next character stored in buffer KEYINB at an address now pointed to by the incremented pointer ZPTR1.

Once it is determined that the number of matches equals the length of the input string, then the address MSTRG of the string of characters constructed by routine LOCAT is stored in the pointer ZOUTPO (step 872). Then, after appropriate pointers are set, routine LOCAT does the following: (1) calls routine CRTOFF at step 874 to turn on the monitor 402; (2) calls routine BKLAB at step 876 so that the pointer ZOUTPO correctly points to the beginning of the sought record; and, (3) calls routine OUTMES at step 878 to display on monitor 402 an indication that the desired record has been located.

After the call to routine OUTMES at step 878, routine LOCAT returns processing as indicated by symbol 880 to the calling routine. As described hereinbefore, the return of processing from routine LOCAT ultimately results in another call to routine CMDIN so that the operator can enter a new command key in accordance with the "Function Menu" of FIG. 10. Thus, if the operator desires to continue to search for other labels having character strings matching the input character string presently stored in buffer KEYINB as a result of the last execution of routine LOCAT, then the operator need merely press the "R" key in reponse to the next appropriate prompt on monitor 402 in order to call the routine REPT which is described immediately below.

ROUTINE REPT

Routine REPT, called when the "R" key is pressed, allows the data processing means 108 to continue searching for yet another address record on the tape which might include a character string which might match the character string keyed in to keyboard 406 for storage in buffer KEYINB in response to the previous call to routine LOCAT. In order to faciliate this continued search, routine REPT first calls routine FWLAB to put the contents of the next addressee's record into the buffer INBF. Thereafter routine REPT stores in a pointer at address ZPTR1 the first address in buffer ZOUTPO to reflect the present label being processed. Likewise, routine REPT stores in a pointer at address ZPTR1+1 the address of location ZOUTPO+1. Then routine REPT calls routine OUTMES so that the message "SEARCHING" is displayed on monitor 402. Then processing jumps to an instruction stored at address LOCATOB in routine LOCAT, at which point processing follows the steps described above with reference to routine LOCAT.

ROUTINE TSTMOD

The routine TSTMOD is called when the "Z" key on keyboard 406 is pressed. The routine TSTMOD is a self-test mode routine which, when entered, toggles a test mode flag TSTMODFG. When the test mode flag TSTMODFG is turned on, all external hardware lockup groups associated with the processing executed by the data processing means 108 are bypassed. The routine TSTMOD first clears the screen of monitor 402 using a call to routine CLRCRT. Thereafter the flag TSTMODFG is checked. If the value of the flag TSTMODFG is non-zero, routine OUTMES is called to display on monitor 402 the message "TEST MODE CANCELED". If the flag TSTMODFG is zero upon entering into the routine TSTMOD, routine OUTMES is called to display on the monitor 402 the message "TEST MODE TURNED ON". After displaying an indication that the test mode is turned on, the routine TSTMOD toggles flag TSTMODFG by setting it equal to zero. Then routine TSTMOD calls routine CLRCRT to clear the monitor 402, after which routine TSTMOD calls routine DSPLB to display the current address record corresponding to the current label being processed.

ROUTINE COMROT

The routine COMROT is called when the "P" key is pressed on keyboard 406. FIG. 11 is a diagram showing processing steps included in the routine COMROT (also known as the routine IJCOM). The processing steps included in routine COMROT, as well as the various routines ultimately called thereby (such as routines UNMOD, TRIJ, TRACK, and PRINT) are also illustrated to some degree by the timing diagram of FIG. 6. FIG. 6 has across its top margin a time axis and down its left margin a listing of various data pins associated with signals either sent or received from the computer 108 on associated cable lines.

Early in its processing the routine COMROT resets the exit flag EXITFG (step 870) and calls the routine RGETKEY (step 872) which effectively resets the routine GETKEY. The routine COMROT then determines (at step 874) whether this call to routine COMROT is the first such call. In this regard, a flag IJSTRTFG is checked in this determination. If the call to routine COMROT is a first, the flag IJSTRTFG is made non-zero (step 876). In addition, on a first call to routine COMROT the following steps are executed: shuttle means 254 is disabled (step 878); the screen of monitor 402 is cleared (by a call to routine CLRCRT at step 880); an output message ("PLEASE POWER UP I/J PRESS ANY KEY TO CONTINUE") is produced in connection with a call to routine OUTMES at step 882; and, routine ANYKEY is called at step 884 to await an operator's response in pressing any key on the keyboard 406. In the above regard, at step 878 the shuttle 254 was disabled by loading a hexadecimal "00" value into location IJBDAT so that pin 458 has a signal which disables the shuttle 254.

The processing of routine COMROT continues at step 888 regardless of whether this call to routine COMROT is a first call. At step 888 the printer start flag IJIFR is set. Thereafter, after clearing the screen of monitor 402 by a call to routine CLRCRT at step 890, routine COMROT calls routine OUTMES at step 892 to display on the screen of monitor 402 the message "PLEASE PUT IJ IN PRINT MODE PRESS ANY KEY TO CONTINUE". A call to routine ANYKEY is made at step 894 to await the operator's response. After the operator's response to the last output message, routine COMROT calls routine RESETIJ (step 896). Routine RESETIJ sends a reset pulse (shown at a time T=6 on FIG. 6) to the printer 104 on a line of cable 420 corresponding to pin 456. Prior to the sending of this reset pulse any noise or extraneous activity communicated from the printer to pin 452 (such as that shown between times T=1 and T=2) has no effect. After sending the pulse, the routine RESETIJ waits for the printer to "settle down". The printer 104 is determined to "settle down" when a low start pulse is received at pin 452 corresponding to bit 3 of location IJIFR. Once this low signal at pin 452 occurs, (shown at a time T=7 in FIG. 6), routine RESETIJ is in a position to remove the reset signal at pin 456 (which it does substantially at the time T=7) and to return processing to the calling routine COMROT. If for some reason the printer 104 is unavailable, then the flag EXITFG is set.

The routine COMROT then calls routine CLRCRT (step 898) to clear monitor 402 in preparation for a call to routine OUTMES (step 900). Upon being called the routine OUTMES displays on the screen of monitor 402 the message "PLEASE PRESS START SWITCH ON IJ PRESS ANY KEY TO CONTINUE". Thereafter routine ANYKEY and routine CLRCRT are called at respective steps 902 and 904 in a similar manner to that described above. Then routine COMROT is again in position to call the routine OUTMES (step 906) so that the message "PLEASE WAIT" can be displayed on the screen of monitor 402. The wait is occassioned by a call to routine LNGWAIT (step 908) which calls a standard Apple Computer "WAIT" Routine as many times as indicated by a value stored in the index register X (XR X). For this particular call, XR X is set to hexadecimal "1C".

Having waited for a sufficiently long time, the routine COMROT then calls the major routine UNMOD at step 910. The UNMOD is described herein in further detail with reference to FIG. 12. The routine UNMOD essentially places into the appropriate buffer (either buffer INBF or buffer OUTBF) the presently available data from the tape. The available data from the tape is stored in buffer INBF (most likely as a result of an earlier call to routine RECIN). Routine UNMOD then executes a loop which includes a call to routine TRIJ. The routine TRIJ is responsible for putting the input data (from either buffer INBF or buffer OUTBF) into a printer buffer IJBF and for calling routines SNDBF and TRACK. The routine TRIJ calls a routine BLDCLBF to build a buffer containing insertion machine control data, and also calls a routine BLDBF to build the buffer IJBF which contains not only the insertion machine control data but also text data to be associated with each label to be printed by the printer 04. Thereafter, routine TRIJ calls (1) routine SNDBF (which sends the insertion machine control signals to the logic circuitry 180 of the insertion machine) and (2) routine TRACK. As seen hereinafter with respect to FIG. 13, routine TRACK determines when an envelope is to be printed by the printer 104 and activates the printer 104 for printing the envelopes. Routine UNMOD repeatedly calls the routine TRIJ fetching more data (through a call to routine RECIN) from the storage medium as necessary for the continual processing of envelopes until an end of file (EOF) is encountered on the storage medium. When an EOF is encountered during the execution of routine UNMOD, processing returns to routine COMROT which then resets appropriate flags (step 912) and displays an output message (by a call to routine OUTMES at step 914) indicating that the print mode is exited and that the key "M" on keyboard 406 should be pressed for a display of the "Function Menu" on the screen of monitor 402. Thereafter the shuttle 254 is disabled (step 916) in a manner understood from the foregoing discussion and the monitor 402 is turned on (step 918).

Figure 12:
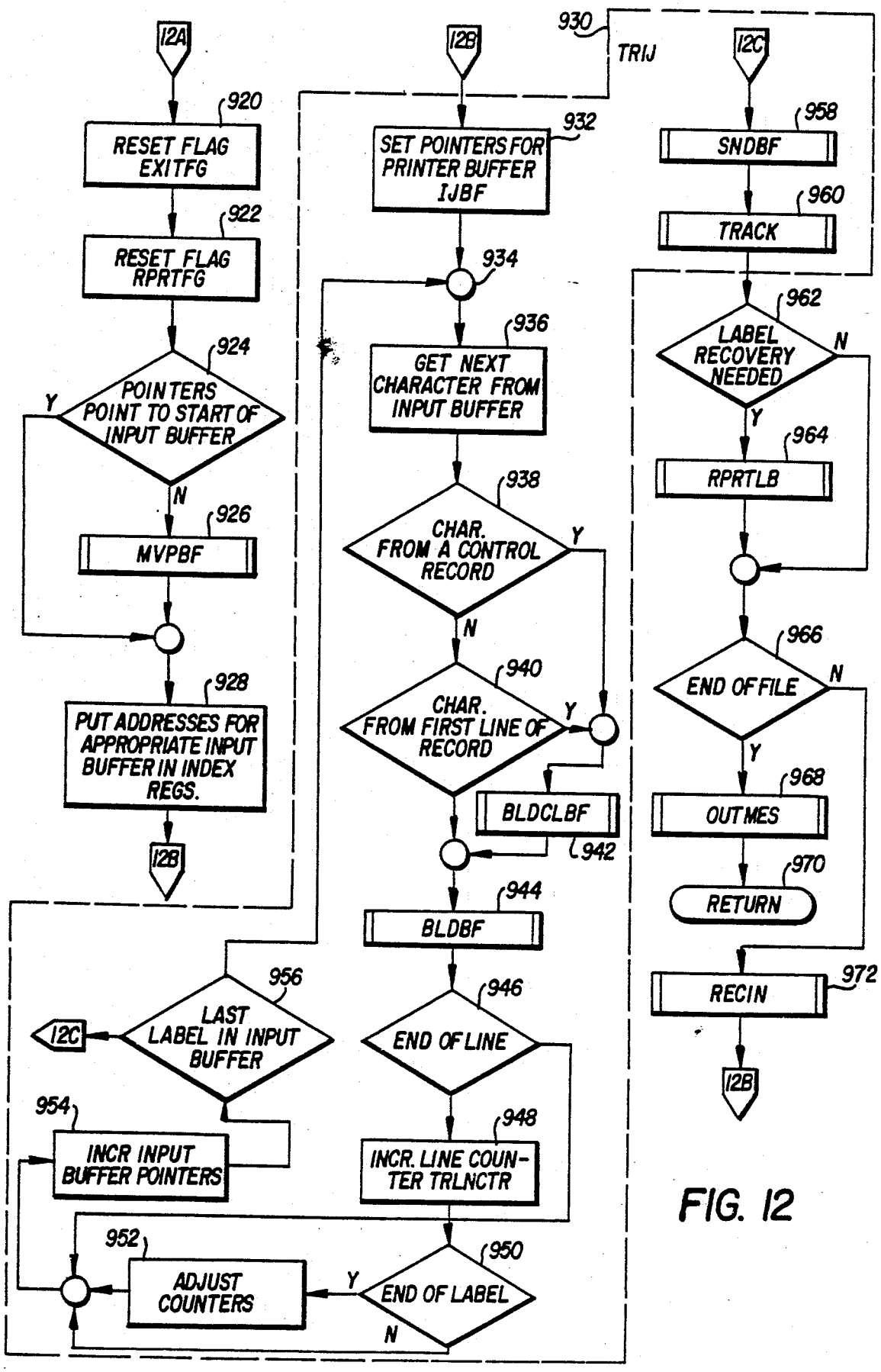
FIG. 12 is a diagram showing processing steps included in routines UNMOD and TRIJ executed by data processing means according to an embodiment of the invention.

Various processing steps associated with the routine UNMOD are described in connection with FIG. 12. Early in its processing the routine UNMOD resets the exit flag EXITFG (step 920) and resets the reprint flag RPRTFG (step 922). At step 924 the routine UNMOD checks to determine whether special processing, particulary a call to routine MVPBF at step 926, is required. In particular, at step 924 checks are made to determine if the pointer at location ZOUTPO points to the first address of buffer INBF and whether the pointer at location ZOUTPO+1 points to the last address in the buffer INBF. If either of these conditions are not satisfied, the routine MVPBF is called (step 926) to move a number of labels (given by the value in the accumulator) from an address in buffer INBF pointed to by the pointer ZOUTPO to a buffer OUTBF. Thereafter, at step 928, addresses for the appropriate input buffer are placed in the index registers XR X and XR Y. In this respect, if a buffer had to be partially moved using a call to routine MVPBF, index register X is loaded with the first address of buffer OUTBF and index register Y is loaded with the last address of the output buffer OUTBF. On the other hand, if it were determined at step 924 that a call to routine MVPBF was not necessary, index register X is loaded with the first address of the buffer INBF and index register Y is loaded with the address of the last address in buffer INBF. Thus, index registers X and Y point to addresses for either buffer OUTBF or buffer INBF depending on whether routine MVPBF had to be called.

With the appropriate input buffer addresses in the index registers X and Y, the routine UNMOD calls routine TRIJ to transmit a block of data to the printer 104. With reference to FIG. 12, the broken lines 930 frame various processing steps associated with the routine TRIJ which is called by routine UNMOD. Early in its processing the routine TRIJ sets pointers (at step 932) to a buffer IJBF which will contain data for transmission to the printer 104. In this respect, the pointer at location IJBFTTR is used as a pointer to the beginning of the buffer IJBF and the pointer at location IJBFPTR+1 is used as a pointer to the last address in buffer IJBF. The routine TRIJ then initializes or resets various flags, counters, and indices, such as those at locations ACTLBP (active control buffer index); TRLNCTR (line counter); BLKCTLLN (block control flag); and, CTLCHRCTR (control character counter). Thereafter, the routine TRIJ begins executing a loop at location TRIJ6 represented by symbol 934.

In the loop at step 936 a pointer is used to obtain the next character in the appropriate input buffer (either buffer INBF or buffer OUTBF). Once the next character is obtained, the value at flag BLKCTLLN is checked for a zero value to determine whether the character is included in a block control line. If not, the value at flag TRLNCTR is checked (step 490) to determine whether the character is from the first line in a record (that is, the first line in a label). If it is determined that the character was from either a block control line or the first line of a record, a call is made at step 942 to the routine BLDCLBF, after which a call is made to routine BLDBF at step 944. Otherwise, processing continues directly to call routine BLDBF at step 944.

The routine BLDCLBF uses the character just obtained from the appropriate input buffer to build a control line buffer at an address pointed to by pointer CTLBFPTR The buffer built by routine BLDCLBF, hereinafter referred to as the control line buffer, contains data corresponding to the first line in each record or label on a tape. If upon a call to routine BLDCLF it is determined that the obtained character is the first character in the control line, then the address of the least significant bit (LSB) of the control line buffer is computed and stored at location CTLBFPTR. The address of the most significant bit of the control line buffer is computed and stored at the location CTLBFPTR+1. Further, if a character is the first character in the control line buffer, the value stored at address IJRPCTR (a hexadecimal value indicative of the repeat count) is stored in the first byte of the control line buffer.

On each call to routine BLDCLBF the routine BLDCLBF examines the obtained character to determine if it is a hexadecimal value indicative of a space or a "LF" line feed. If a space is encountered, then routine BLDCLBF replaces the hexadecimal value indicative of a space with a hexadecimal value indicative of a period. If a "LF" is encountered, the routine BLDCLBF replaces the hexadecimal value indicative of the "LF" with a hexadecimal value indicative of "0". Before returning to its calling routine, the routine BLDCLBF increments the pointers at addresses CTLBFPTR and CTLBFPTR+1 as long as appropriate.

The routine BLDBF builds a buffer of data for the printer 104. In particular, the routine BLDBF takes a value in the accumulator indicative of a character and stores it in an address in buffer IJBF pointed to by pointer IJBFPTR. The number of characters stored in the buffer IJBF by routine BLDBF is stored in a counter at location IJBFLEN. Through each call to routine BLDBF the pointer IJBFLPTR and the counter IJBFLEN are incremented to reflect the storage in buffer IJBF of another character for this call to routine BLDBF.

After the character is stored in buffer BLDBF a check is made at step 946 to determine if the character just stored in buffer IJBF was indicative of a "LF" or line feed. If a "LF" character was encountered, the line counter TRLNCTR is incremented at step 948. Then, at step 950, the character transferred to buffer IJBF in the previous execution (as opposed to the present execution) of the loop commencing at step 934 is examined to determine whether it also corresponded to a "LF" character. If this previous character also corresponded to a "LF", then it is realized that a "CR" "LF" "LF" sequence was encountered in the buffer, meaning that the end of a label or record has occurred. When the end of a label from the appropriate input buffer is found, counters including the line counter TRLNCTR and the control character counter CTLCHRCTR are reset to zero at step 952. Step 952 also includes the decrementing of the transfer label count TLBCTR when it is determined that the end of a label has been encountered.

After the resetting of counters at step 952, or alternatively after negative conditions are determined at either of steps 946 or 950, processing continues at step 954 wherein pointers ZPTR1 and ZPTR1+1 are incremented to point to current addresses in the appropriate input buffer. A check is then made at step 956 whether the current value of the transfer label count TLBCTR, which is decremented at step 952, is zero. If the value of TLBCTR is non-zero, then processing loops back to the instruction represented by symbol 934 so that another character may be obtained from the input buffer. Otherwise processing continues in the manner hereinafter described.

Once it has been determined that the last label in the input buffer has been loaded into the printer buffer IJBF, the routine TRIJ calls routine SNDBF at step 958. The routine SNDBF essentially functions to send a number of characters stored in the buffer IJBF to the printer 104. The number of characters to be sent is stored in the address INBFLEN. In order to send the characters in buffer IJBF to the printer 104, routine SNDBF checks the value of bit 4 at address IJIFR (corresponding to pin 452) to determine if a start pulse has yet been received from the printer 104. Such a pulse is shown commencing at time T=7 in FIG. 6. When the commencement of such a pulse is detected, the routine SNDBF initiates a pulse at pin 451 by storing an appropriate value at bit 1 of address IJBDAT to activate the data busy line. FIG. 6 shows such a pulse occurring at a time T=7.5.

The routine SNDBF then executes an internal loop wherein for each loop execution the character in buffer IJBF pointed to by pointer IJBFPTR is stored at address IJADAT. The pointer IJBFPTR is incremented during each execution of the loop. With the character stored at address IJADAT appropriate signals indicative of the character are set at data pins 470, 466, 462, 460, 464, 468, 472, and 474 which correspond respectively to bits 0–7 of the two-byte character. In FIG. 6 the storage of the character at address IJADAT is shown at time T=8. At substantially the same time T=8 a hexadecimal "09" is loaded into address IJBDAT once per loop execution so that a pulse appears at pin 476 so data indicative of the character can be strobed out of the address IJADAT. The plurality of strobe pulses and data pulses corresponding to the plurality of executions of this particular loop in routine SNDBF are represented in FIG. 6 by a rectangularly circumscribed X.

After data has been strobed out of the buffer IJBF, the strobe pin 476 is reset (shown in FIG. 6 at time T=9) and the data lines associated with bits 0 through 7 of address IJADAT are reset at zero. The routine SNDBF then decrements the counter IJBFLEN, checking after each decrementation to determine whether the counter IJBFLEN value becomes zero to indicate that the entire buffer IJBF has been sent to the printer 104. If the counter IJBFLEN is greater than zero, execution of the aforedescribed loop continues. Once all the characters in the buffer IJBF have been passed to the printer 104, the routine SNDBF terminates the pulse at line 451 (shown at time T=9 in FIG. 6) to reset the data busy line.

After calling routine SNDBF, the routine TRIJ calls at step 960 the routine TRACK. Routine TRACK, further described herein with reference to FIG. 13, essentially tracks envelopes passing through the printer 104 and the buffer and turnover assembly 106 in route to the inserter machine 100. After the call to routine TRACK, the routine TRIJ returns processing to its calling routine UNMOD. Upon return to routine UNMOD, the routine UNMOD checks the value of repeat flag RPRTFG at step 962 to determine whether a label recovery is needed. If a label recovery is required as indicated by a nonzero value in flag RPRTFG, a call is made to routine RPRTLB at step 964. The routine RPRTLB is described hereinafter in further detail with reference to FIG. 14, and essentially concerns processing steps executed when it is determined that a printed envelope has been damaged and that a replacement envelope should be printed.

Whether or not a call to routine RPRTLB was required to produce a label recovery or replacement envelope, the routine UNMOD checks at step 966 to determine whether an end of file indication has been encountered on the storage medium. In particular, routine UNMOD checks a line corresponding to pin 494 of card 414 for EOF indication. If an EOF is encountered, the message "END OF FILE" is displayed on the screen of monitor 402 as a result of a call to routine OUTMES at step 968. Step 968 is followed by a return as indicated by symbol 970 to the calling routine COMROT. If an EOF is not encountered, the routine UNMOD calls routine RECIN at step 972 to get another block of data from the storage medium. The operation of routine RECIN has been described above in connection with a call thereto by routine START, so that further description at this point of the operation of routine RECIN is unnecessary. After obtaining another block of data from the tape through a call to routine RECIN, the routine UNMOD loops back to again call the routine TRIJ to prepare the printer input buffer IJBF for the data acquired from the new block of tape. In this manner the routine UNMOD continues to loop back to call routine TRIJ after obtaining new blocks of data through calls to routine RECIN at step 972. The loop is repeatedly executed until the EOF is encountered at step 966 as described above.

Figure 13:
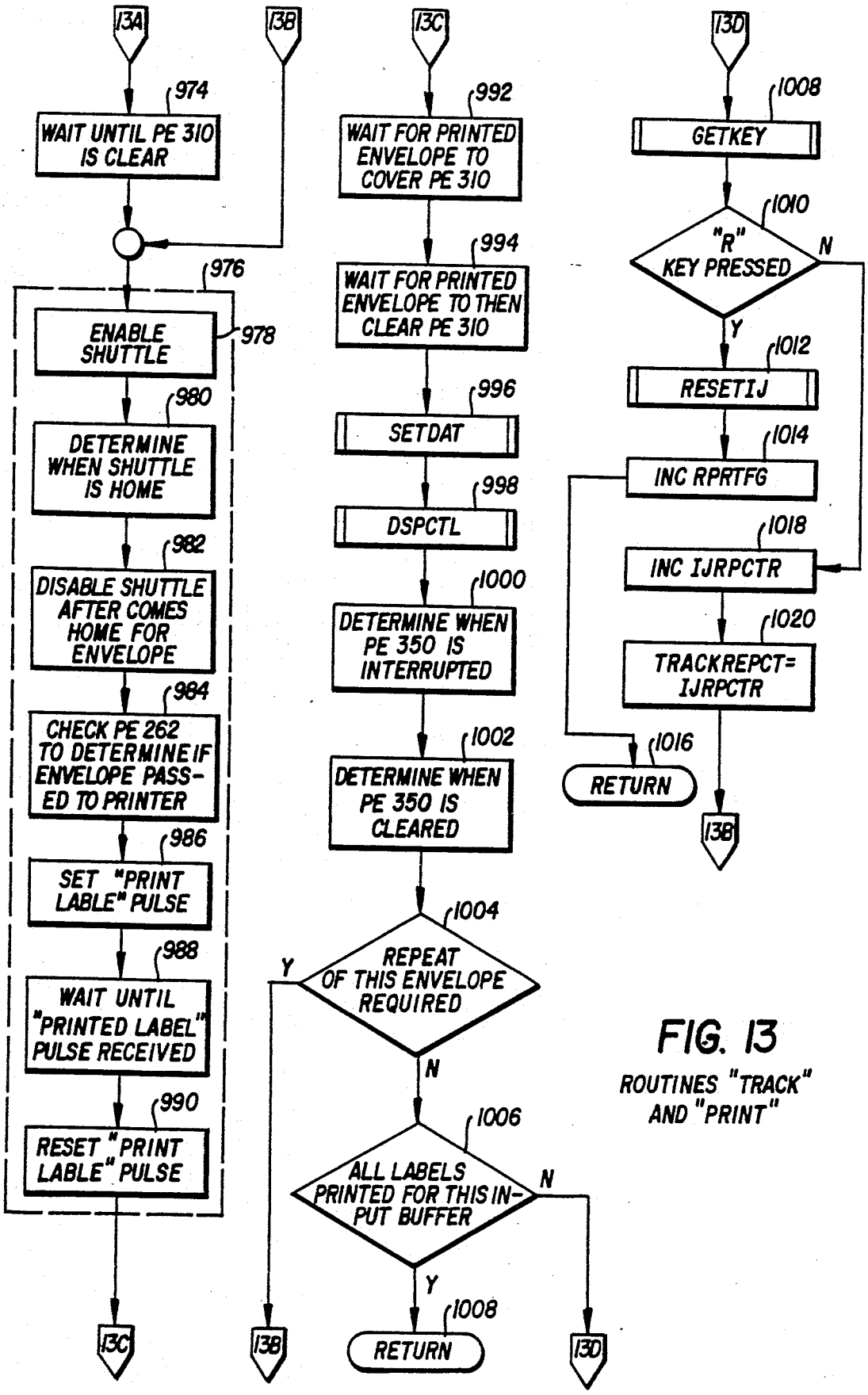
FIG. 13 is a diagram showing processing steps included in routines TRACK and PRINT executed by data processing means according to an embodiment of the invention.
Figure 14A:
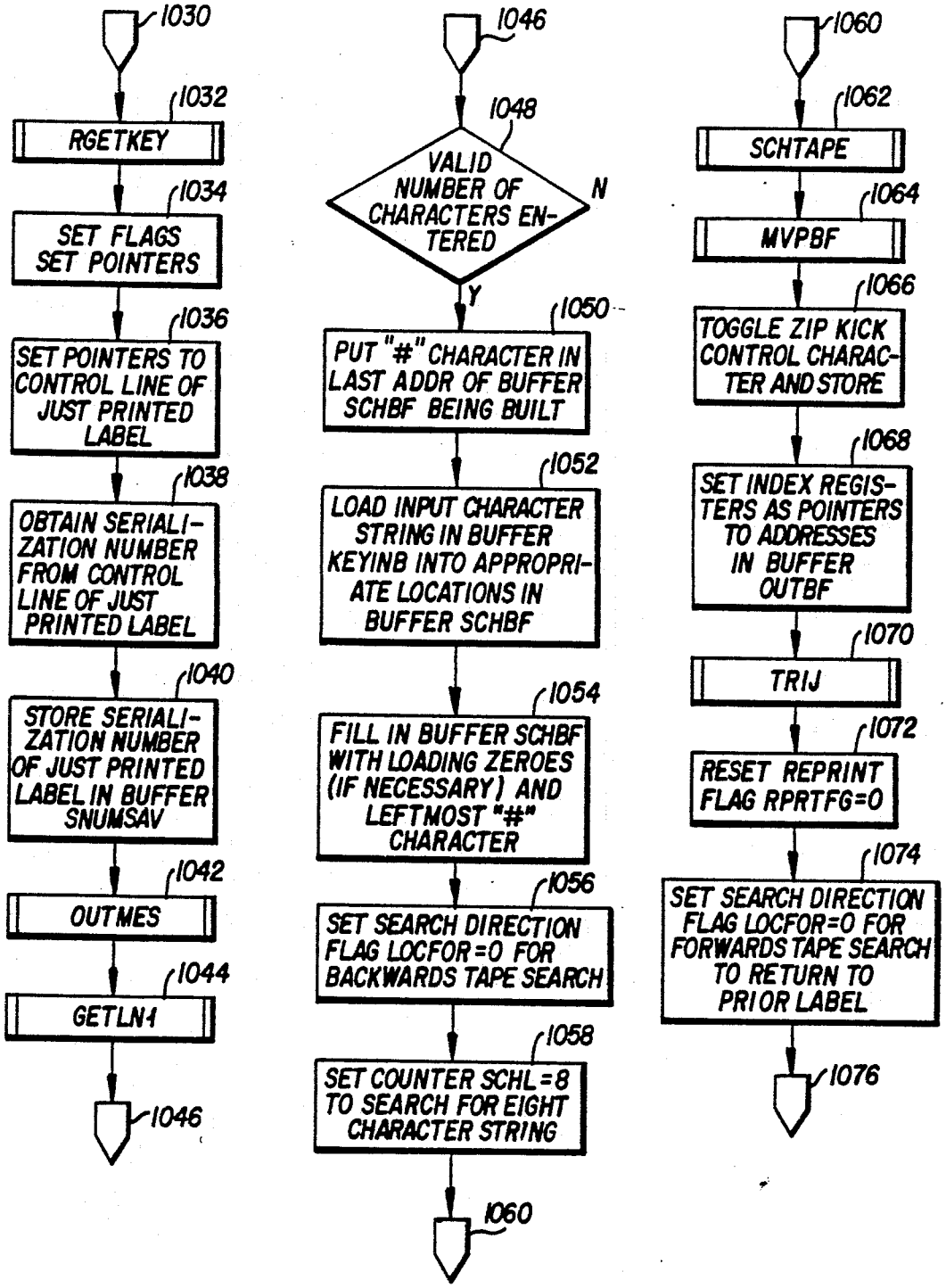
FIGS. 14A and 14B are diagrams showing processing steps included in a routine RPRTLB executed by data processing means according to an embodiment of the invention.
Figure 14B:
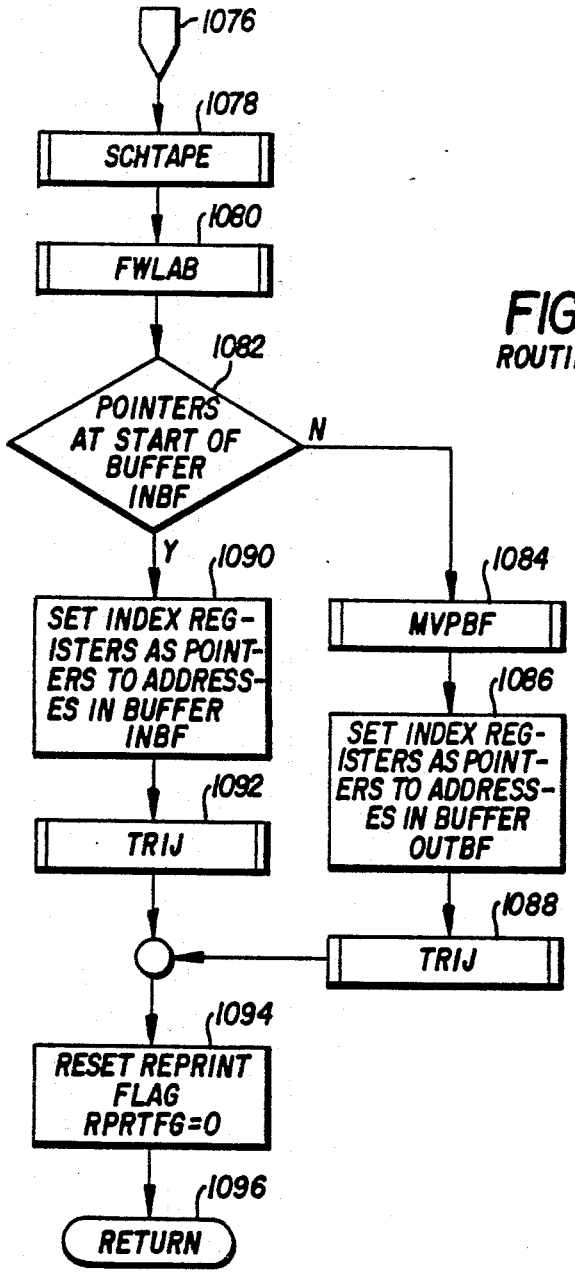

The routine TRACK, called by the routine TRIJ in the manner described above, includes various processing steps as indicated in FIG. 13. Early in its processing the routine TRACK resets or initializes appropriate flags and counters, including pointer SETDATBP (set data control buffer pointer), flag ERRFG (error flag); flag EXITFG (exit flag); and flag RPRTFG (reprint flag). Further, routine TRACK stores in location TRACKLBCTR the number of labels currently contained in the printer buffer IJBF.

Inasmuch as routine TRACK essentially tracks the processing of an envelope through the printer 104 and the buffer and turnover assembly 106, numerous steps included in routine TRACK are understood in conjunction with FIG. 6. In this regard, at step 974 routine TRACK determines whether the photodetector or photoeye 310 is clear by looking for the absence of a pulse at pin 434. If a pulse is occurring at pin 434, the routine TRACK waits until the pulse is over as an indication that the photoeye 310 is clear. When the photoeye 310 is clear the routine TRACK knows that it is in position to feed an envelope from the hopper 250 using the shuttle means 254. This check is made by examining the bit of location IOBDAT which corresponds to pin 434.

After determining that the photoeye 310 is clear, the routine TRACK calls a routine PRINT. Routine PRINT is framed in broken lines 976 in FIG. 13. Routine PRINT enables the shuttle 254 at step 978 by loading a hexadecimal "20" into location IJBDAT so that the pulse will commence at pin 458 at time T=10. Thereafter at step 980 routine PRINT examines the pin 429 associated with the shuttle home detector 260 to determine if the shuttle means 254 is in a "home" position proximate the envelope supply means 250 to extract a new bottom-most envelope therefrom. In FIG. 6 it is shown that the shuttle 254 reaches home at time T=11. After confirmation has been received that the shuttle 254 has reached home in the manner just described, routine PRINT terminates the pulse at pin 458 to disable the shuttle 254 as indicated at step 982. Presumably at this point the shuttle 254 has extracted the first envelope (referred to as "E1" in FIG. 6) so that the envelope E1 can be passed to the printer 104.

At step 984 routine PRINT checks to determine if the photoeye 262 has been interrupted by the passage of envelope E1. In this respect, routine PRINT looks for a pulse on pin 428 which, in accordance with the timing diagram of FIG. 6, occurs at time T=12. Once it is determined that the photoeye 262 has been interrupted and the envelope E1 transported thereover, the routine PRINT sends a "print label pulse" at pin 453, the pulse being sent by the loading of a hexadecimal "02" into location IJBDAT. In FIG. 6 such a pulse is shown as commencing at time T=13. Routine PRINT then waits at step 988 until it receives on pin 454 a "printed label" pulse whereby the printer 104 indicates that printing of the label on envelope E1 is complete. As shown in FIG. 6, the "printed label" pulse commences at a time T=14. The "printed label" pulse is determined at step 958 by checking the value in bit 6 of location IJBDAT. Once the "printed label" pulse has been received, the routine PRINT can reset the "print label" pulse at pin 453 by loading a hexadecimal "00" into location IJBDAT, which is shown in FIG. 6 as occurring slightly after time T=14. With the label for envelope E1 having been printed in this manner, the routine PRINT returns to its calling routine TRACK at step 992.

At step 992 the routine TRACK waits for the printed envelope (such as envelope E1 and the example under discussion) to cover the photoeye 310. In this respect, at step 992 routine TRACK checks the bit of location IOBDAT corresponding to pin 434 to determine if the photoeye 310 has been blocked. In FIG. 6 a pulse indicating a blockage of the photoeye 310 is shown as occurring at time T=16. Once it has been determined that the photoeye 310 has been covered, routine TRACK then waits at step 994 for the printed envelope to clear the photoeye 310 by checking the bit in location IOBDAT described above. In FIG. 6 it is seen that the photoeye 310 is cleared at time T=17.

With photoeye 310 having been both covered and cleared as detected in respective steps 992 and 994, the routine TRACK is ready to send data indicative of insertion machine control signals to the control logic 180 of insertion machine 100. The routine TRACK calls routine SETDAT at step 996 to accomplish this transmission of signals. Routine SETDAT takes data pointed to in an active control buffer by pointer SETDATBP, compresses the data into two data bytes (at locations CNTLDAT and CNTLDAT+1) and outputs these two bytes at the inserter ports IOADAT and IOBDAT. In FIG. 6 the transmission of the insert station control data for envelope E1 is shown as occurring at time T=17 and ending at time T=18. The logic circuitry 180 of the insertion machine 100 applies as appropriate the activating signals to the stations 152*a* through 152*k* of the insertion machine 100 in the conventional prior-art manner.

Having sent the insertion machine control signals to the insertion machine logic 180 through the call to routine SETDAT as described at step 996 above, the routine TRACK subsequently calls at step 998 routine DSPCTL which basically functions to display insertion control data on the screen of monitor 402. Routine TRACK then determines at step 1000 whether the photoeye 350 has been interrupted, meaning that the envelope E1 is now in position over the turnover device 304 in the buffer and turnover assembly 106. In this respect, the photoeye 350 is blocked as it looks down upon the envelope E1 which lies on the transport table 300 over the turnover device 304 recessed therein. Step 1000 involves checking the bit in location IOBDAT that corresponds to pin 425 in an effort to determine if the photoeye 350 is blocked. Once it is determined that the photoeye 350 is blocked (as shown at time T=18 in FIG. 6), the suction cups 340 of the turnover device 304 are allowed to communicate with a vacuum so that the envelope is secured to the turnover device 304. Thereafter, the turnover device 304 pivots about the axis 322 in the manner earlier described so that the envelope will be deposited with its label facing down on the envelope track 126 in the position shown by the envelope a14 indicated in broken lines in FIG. 1.

In the above regard, recall that the envelope had been printed at printer 104 with its label facing upwardly. The turnover device 304 turns the envelope over so that the label will face downwardly to facilitate stuffing of the envelope at the stuffing station 156. Moreover, the turnover device 304 automatically introduces the printed envelope onto the envelope conveyor track 126 of the insertion machine 100 where it is thereafter indexed in the direction of arrow 122. As soon as the envelope E1 reaches the position shown by the notation $a_{12}$ on the envelope track 12, station 1 of the insertion machine selectively pulls an insert from its hopper and deposits the same (if any) on the insert track 124 at a position shown by the corresponding notation $a_{12}$. Upon successive machine cycles each successive station 152 is selectively enabled to pull an insert as required for envelope E1. When envelope E1 reaches the roller 153, the envelope E1 is accelerated so that it is now in a position on envelope track 126 directly alongside its inserts on track 124. The envelope E1 can then be opened by the opening means 154; stuffed at the stuffing station 156; moistened at the flap moistening means 162; closed at the flap closing station 164; and, discharged by roller 166 onto the discharge conveyor 168. The position of the discharged envelope on the conveyor 168 relative to the far side 172 of the conveyor 168 depends upon whether the control line buffer for envelope E1 indicates that the zip kicker 176 is to be activated.

Routine TRACK then determines at step 1002 when the photoeye 350 is clear as a result of the "turnover" of the envelope which formerly interrupted the photoeye 350. In this respect the routine TRACK checks the bit in location IOBDAT just described to determine when clearance of the photoeye 350 occurs as it is shown to do at time T=19 in FIG. 6.

When envelope E1 is on its way on the envelope conveyor 126 as described above, the routine TRACK checks to determine whether a repeat of the envelope just printed is required. In this respect, at step 1004 the routine TRACK checks the value of counter TRACKREPCT for a non-zero value at step 1004. Inasmuch as the counter TRACKREPCT was originally set at the beginning of routine TRACK for each envelope (as determined by the value stored at bit positions 10 and 11 of control record 722), and inasmuch as the counter TRACKREPCT is decremented (generally from the original value 1) for each envelope, a zero value in the counter TRACKREPCT indicates that all repeats have been performed. If, for example, the routine TRACK had originally set the counter TRACKREPCT to "3" to indicate that three identical envelopes were to be processed, and if only one such envelope had been processed so far, the decremented value of counter TRACKREPCT would be "2". With a non-zero value determined in counter TRACKREPCT the routine TRACK would loop back to call the routine PRINT two further times. In this example, after the routine PRINT had been called two further times, the counter TRACKREPCT would decremented to zero so that execution would pass from step 1004 to step 1006.

At step 1006 the routine PRINT decrements the label counter TRACKLBCTR (which was preset to indicate the number of labels in the input buffer IJBF) and checks whether the decremented value of the label counter TRACKLBCTR becomes zero to indicate that all labels have been printed for the input buffer. If all labels from the input buffer have been processed, the routine TRACK returns as indicated by symbol 1008 to the routine TRIJ from which it was called. If further labels still remain in this input buffer, the routine TRACK calls subroutine GETKEY at step 1008 to determine whether the operator has pressed a new key on keyboard 406. At step 1010 routine TRACK determines whether a "R" key was pressed to indicate that an envelope has been damaged and a need exists to reprint the envelope. Hence, at this stage of execution, pressing the "R" key indicates that an envelope should be reprinted, rather than the repeat of a previous command as is signified by the "R" key at a level of processing in response to the "Function Menu".

If it is determined at step 1010 that a reprint is required, then a call is made at step 1012 to routine RESETIJ which, as described above, resets the printer 104 and destroys any unprinted labels. Thereafter at step 1014 the reprint flag RPRTFG is incremented before a return to calling routine TRIJ as indicated at symbol 1016. Routine TRIJ in turn returns processing to its calling routine UNMOD. Routine UNMOD then checks at step 962 to determine if the reprint flag RPRTFG has been set to a non-zero value to indicate that a label recovery is required. A non-zero value of the reprint flag RPRTFG causes the routine RPRTLB to be called as indicated at step 964.

If it is determined at step 1010 that a reprint is not required, then routine TRACK executes step 1018 and 1020 to essentially reset the repeat counter TRACKREPCT prior to looping back to again call the routine PRINT. During repeated calls the routine PRINT causes the printing of envelopes for successive customers. With respect to the example of FIG. 6, a further call to routine PRINT concerns the envelope E2. In particular, FIG. 6 shows that step 978 is executed at time T=19 to enable the shuttle 254 in an effort to obtain envelope E2.

ROUTINE RPRTLB

The routine RPRTLB is used when an already-printed envelope has been damaged in the course of processing by the insertion machine 100 and a reprinted envelope is required. As explained above, the operator can initiate the reprinting of an envelope by pressing the "R" key on keyboard 406. The routine RPRTLB saves the sequence or serialization number of the envelope just printed for customer $C_n$ and allows for the sequence number of the desired label to be entered on the keyboard 406. The storage medium is then searched backwards for the serialization number corresponding to the damaged envelope. When information corresponding to the damaged label is located on the storage medium, the label is reprinted on a new envelope and data again passed to the logic circuit 180 of the insertion machine 100. After the damaged label is reprinted, the storage medium is then searched forwardly for a data record corresponding to the envelope for customer $C_n$ which had been printed just prior to the interruption by the operator by the pressing of the "R" key. The routine RPRTLB then looks for and obtains the next record on the storage medium so that processing of the envelopes can be continued with customer $C_{n+1}$ despite the temporary interruption. Processing steps included in routine RPRTLB are further understood with reference to FIGS. 14A and 14B.

Shortly after entering the routine RPRTLB as shown by the symbol 1030, the routine RGETKEY is called at step 1032 to reset the flag GETKEY. At step 1034 further flags and pointers are set, particulary exit flag EXITFG is set equal to zero and the pointer SETDATBP pointing to the last valid buffer is decremented. At step 1036 pointers ZPTR1 and ZPTR1+1 are respectively set to the first and last addresses in the control line buffer CTLBFTAB (step 1036). Routine RPRTLB is then in a position to obtain the serialization number from the control line of the record or label just printed for customer $C_n$. Obtaining the sequence or serialization number is represented by step 1038, which includes scanning the current control line buffer for a hexadecimal "23" character corresponding to the first "#" character. It will be recalled that "#" characters are used in the control line before the most significant digit and after the last significant digit of the serialization number. When the serialization number for the just printed label is obtained, it is saved for future relocation purposes in a buffer SNUMSAV as indicated at step 1040.

Having located and saved the serialization number of the just printed label, the routine RPRTLB calls routine OUTMES at step 1042 to cause the display on monitor 402 of the message "ENTER SEQUENCE NUMBER-". Routine RPRTLB then calls at step 1044 the routine GETLN1 which stores a string of input characters entered by the operator on keyboard 406 into a buffer KEYINB. The number of input characters included in the buffer KEYINB is determined by the routine GETLN1 and stored in the index register X. After the routine GETLN1 has thusly obtained the string of input characters, routine RPRTLB checks the value in the index register at step 1048 to determine whether a valid number of characters was entered by the operator. Eight or more entered characters are considered to be invalid and result in an error message.

Having obtained the serialization or sequence number of the damaged envelope in the manner described above, the routine RPRTLB begins to build a buffer SCHBF which will contain values suitable for comparison tests with serialization numbers on the storage medium. In this regard, a hexadecimal value "23" corresponding to a "#" character is placed in the last address of the buffer SCHBF (step 1050). Thereafter at step 1052, the routine RPRTLB loads the input character string in buffer KEYINB into appropriate locations in the buffer SCHBF. As indicated at step 1054, if necessary leading zeros are filled in the buffer SCHBF. Thereafter a left-most "#" character is loaded into the first address of the buffer SCHBF in a manner similar to that described above.

With the buffer SCHBF now containing a recognizable representation of the serialization number for the sought label or record, the routine RPRTLB makes preparations to search backwards on the storage medium. In this respect, the search direction flag LOCFOR is set equal to zero to indicate a backwards tape search (step 1056). Also in connection with the backward search, a counter SCHL is set equal to eight to indicate that an eight character string is being compared (that is, the eight characters in buffer SCHBF).

The routine RPRTLB is then ready for a call to routine SCHTAPE at step 1062. The routine SCHTAPE locates the record or label corresponding to the input serialization number and sets pointer ZOUTPO and ZOUTP1 to appropriate addresses corresponding to data associated with the sought record. After the call to routine SCHTAPE at step 1062, routine RPRTLB calls routine MVPBF at step 1064 to move a number of labels (the number of labels being contained in the accumulator) from the address in buffer INBF pointed to by ZOUTPO to the buffer OUTBF. In this regard, the operation of routine MVPBF can be understood in light of a preceding discussion concerning a similar call to routine MVPBF by routine UNMOD at step 926 of FIG. 12.

At step 1066 the routine RPRTLB ultimately toggles a zip kick control character stored at an address computed by summing the first address of buffer OUTBF and a hexadecimal "1D" value. The zip kick control character is used to control the position of the zip kicker 176 of FIG. 1. It will be recalled that the position of the zip kicker 176 determines the relative position of envelopes which are discharged onto the discharge conveyor 168. After being toggled, the zip kick control character is restored at the same location.

At step 1068 the routine RPRTLB places the first address in buffer OUTBF in index register X and the last address in buffer OUTBF in index register Y in preparation for a call at step 1070 to routine TRIJ. Routine TRIJ, described in connection with the processing steps framed by broken lines 930 in FIG. 12, obtains data from the suitable input buffer (in this case buffer OUTBF) and prepares a printer buffer INBF. The data in printer buffer INBF is sent by routine TRIJ to the printer 104 through a call to routine SNDBF. Thereafter, routine TRIJ calls the routine TRACK which controls the reprinting of the envelope for customer $C_R$ at printer 104 and controls the travel of the reprinted envelope through the buffer and turnover assembly 106 in the manner described earlier. Envelope labels that are reprinted as a result of a call to routine RPRTLB have a special character, such as an asterisk, printed on the control line of the printed label. In this way, reprinted envelopes are especially recognizable.

Having reprinted the damaged label through processing steps executed in connection with a call to routine TRIJ at step 1070, the routine RPRTLB prepares to return to the record on the storage medium which corresponds to the envelope for customer $C_n$ which had just been printed prior to the operator's request to reprint the damaged envelope. In this regard, at step 1072 the routine RPRTLB resets the reprint flag RPRTFG to zero. At step 1074 the search direction flag LOCFOR is set equal to one to indicate that the tape should now be searched in the forward direction to locate the record corresponding to the envelope label (belonging to customer $C_n$) which had been printed immediately prior to the interruption by the operator. With flag LOCFOR set equal to one, routine RPRTLB calls the routine SCHTAPE at step 1078 to search for the appropriate record. The number of characters being sought by routine SCHTAPE is communicated by the routine RPRTLB. Upon return the routine SCHTAPE places in pointers ZOUTPO and ZOUTPO+1 appropriate addresses for the buffer INBF. Since these pointers essentially point to an envelope label which has already been printed for customer $C_n$ (that is, the envelope that was printed immediately prior to the operator's interruption of processing in order to reprint the damaged envelope), routine RPRTLB then calls at step 1080 the routine FWLAB to advance the storage medium to the next label or record to obtain data for customer $C_{n+1}$.

The pointers ZOUTPO and ZOUTPO+1 returned from the routine FWLAB are checked at step 1082 to determine whether the pointers correspond with appropriate addresses of the buffer INBF. Depending on the results of the check at step 1082, one of two separate routes are utilized to process the envelope for customer $C_{n+1}$. If the result of the test at step 1082 is negative, a call is made at step 1084 to routine MVPBF which, as described hereinbefore, moves a number of labels from the address in INBF pointed to by ZOUTPO to the buffer OUTBF. Thereafter, at step 1086 the index registers XR X and XR Y are used as pointers to appropriate addresses in the buffer OUTBF in the manner understood from preceding discussions. Then a call is made at step 1088 to routine TRIJ. Routine TRIJ functions to (1) place the data in buffer OUTBF into printer buffer IJBF; (2) send the buffer IJBF to the printer 104 (through a call to routine SNDBF), and, (3) initiate the printing and tracking of the label for the envelope (in conjunction with a call to routine TRACK). If, on the other hand, the results of the test at step 1082 is positive, then the index registers XR X and XR Y are simply sent (step 1090) to appropriate addresses in the buffer INBF in a manner understood from the foregoing discussion. Then a call to routine TRIJ is made at step 1092. After a call to routine TRIJ (either at step 1088 or step 1092), the routine. RPRTLB resets the reprint flag RPRTFG at zero (step 1094) and returns processing to the calling routine as indicated by symbol 1096.

Figure 16:
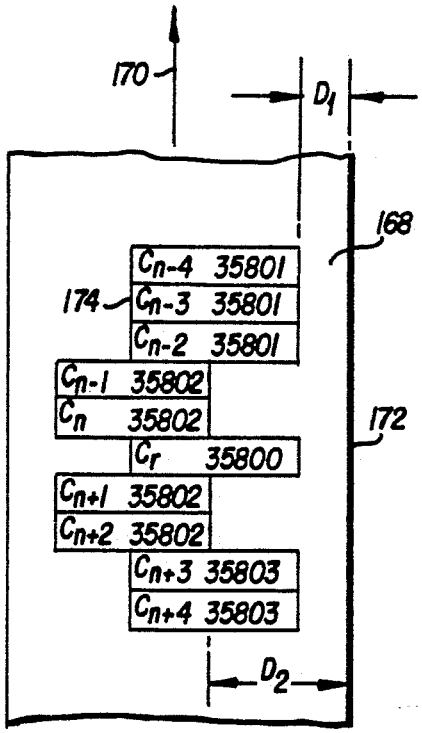

FIG. 16, a top view of the discharge conveyor 168, is useful in understanding the benefit of the routine RPRTLB and the processing steps facilitated by the invention. Assuming that the customer labels are stored on the storage medium in zip code order, FIG. 16 illustrates an ordering of discharged envelopes on the conveyor 168 in accordance with one mode of the invention. In the example depicted in FIG. 16, the printed and stuffed envelope of the last customer having zip code 35801 (in particular, customer $C_{n-2}$) has been processed, as well as printed and stuffed envelopes for two customers having zip code 35802 (customers $C_{n-1}$ and $C_n$). The envelopes having zip code 35801 are distanced from the edge 172 of the discharge conveyor 168 by a distance $D_1$. The envelopes having zip code 35802 are visibly offset from the edge 172 of the conveyor 168 by a greater distance $D_2$.

With further reference to FIG. 16, after the printing by printer 104 of the envelope for customer $C_n$, the operator apparently noticed that an already-printed envelope for a customer having zip code 35800 was damaged by the insertion machine 100. The operator then pressed the "R" key on keyboard 406. Pressing the "R" key caused routine TRACK to follow the affirmative processing route at step 1010 so that routine RPRTLB would eventually be called at step 964 of routine UNMOD. Routine RPRTLB, once called, toggled the zip kick control character at step 1066 and caused the reprinting of the damaged envelope (seen in FIG. 16 as an envelope for customer $C_R$) in connection with a call to routine TRIJ at step 1070. Routine RPRTLB further facilitated the printing of the envelope for customer $C_{n+1}$ through a further call to routine TRIJ (either at steps 1092 or 1088).

In the above regard, the toggling of the zip kick control character at step 1066 of routine RPRTLB causes the zip kicker 176 to be positioned with respect to the discharged conveyor 168 so that when the envelope for customer $C_R$ is discharged by discharge roller 166, the envelope for customer $C_R$ is positioned at the distance $D_1$ from the edge 172 of the conveyor 168. Thus, the envelope for customer $C_R$ is visibly offset from the preceding customers $C_n$ and $C_{n-1}$. Upon discharge of the envelopes for customers $C_{n+1}$ and $C_{n+2}$, the zip kick control character has been toggled again so that all the printed and stuffed envelopes having zip code 35802 are distanced by the distance $D_2$ from the edge 172 of conveyor 168. Thus, the reprinted and stuffed envelope for a customer $C_R$ is visibly offset to indicate that the envelope was reprinted and hence appears physically out of sequence on the conveyor 168. Moreover, as indicated above, the reprinted envelope for customer $C_R$ has a special character printed on its control line. The special character also assists in locating a reprinted envelope which may be out of order on the discharge conveyor 168.

While the invention has been particularly shown and described with reference to the preferred embodiments thereof, it will be understood by those skilled in the art that various alterations in form and detail may be made therein without departing from the spirit and scope of the invention. For example, the particular printer associated with printer means 104 need not necessarily be an ink jet printer as described with reference to an embodiment herein, but in other embodiments can be any suitable printer, such as a laser printer, for example.

The embodiments of the invention in which an exclusive property or privilege is claimed are defined as follows:

1. A method of operating an insertion machine system including an insertion machine of a type wherein a plurality of insert stations are positioned proximate conveyor means travelling therealong for feeding inserts onto said conveyor means, said method comprising the steps of:

accessing a storage medium containing information indicative of customer data for a plurality of customers;

acquiring a string of user-input characters representative of information to be sought on said storage medium;

searching said storage medium for a match between a string of stored characters and said string of input characters;

obtaining from said storage medium information indicative of customer data and insertion machine control signals relative to a customer, said information being associated on said storage medium with a string of matched stored characters;

communicating said insertion machine control signals relative to said customer to at least one insert station;

using said insertion machine control signals to control the selective feeding of inserts from said at least one insert station;

acquiring from a user an indication whether said storage medium is to be searched for a further string of stored characters resembling said string of previously-input characters; and, searching said storage medium for a further string of stored characters resembling said string of previously-input characters.

2. A method of operating an insertion machine system including an insertion machine of a type wherein a plurality of insert stations are positioned proximate conveyor means travelling therealong for feeding inserts onto said conveyor means, said method comprising the steps of:

accessing a storage medium containing information indicative of customer data for a plurality of customers;

acquiring a string of user-input characters representative of information to be sought on said storage medium;

searching said storage medium for a match between a string of stored characters and said string of input characters, said string of user-input characters including in one of its positions a wild card character, said wild card character facilitating the determination of a match when like characters occur for respective positions in said string of stored characters and said string of input characters, said match being affirmatively determined regardless of the character occurring in the position in said string of stored characters corresponding to said wild card position;

obtaining from said storage medium information indicative of customer data and insertion machine control signals relative to a customer, said information being associated on said storage medium with a string of matched stored characters;

communicating said insertion machine control signals relative to said customer to at least one insert station; and, using said insertion machine control siqnals to control the selective feeding of inserts from said at least one insert station.

3. An insertion machine of a type wherein a plurality of insert stations are positioned proximate conveyor means travelling therealong for feeding inserts onto said conveyor means, said system comprising:

means for accessing a storage medium containing information indicative of customer data for a plurality of customers;

means for acquiring a string of user-input characters representative of information to be sought on said storage medium;

means for searching said storage medium for a match between a string of stored characters and said string of input characters, said string of user-input characters including in one of its positions a wild card character, said wild card character facilitating the determination of a match when like characters occur for respective positions in said string of stored characters and said string of input characters, said match being affirmatively determined regardless of the character occurring in the position in said string of stored characters corresponding to said wild card position;

means for obtaining from said storage medium information indicative of customer data and insertion machine control signals relative to a customer, said information being associated on said storage medium with a string of matched stored characters;

means for communicating said insertion machine control signals relative to said customer to at least one insert station; and, means for using said insertion machine control signals to control the selective feeding of inserts from said at least one insert station.

* * * * *